US011066622B2

(12) United States Patent
Fang et al.

(10) Patent No.: US 11,066,622 B2
(45) Date of Patent: Jul. 20, 2021

(54) SYNERGISTIC LUBRICANTS WITH REDUCED ELECTRICAL CONDUCTIVITY

(71) Applicant: AFTON CHEMICAL CORPORATION, Richmond, VA (US)

(72) Inventors: Xinggao Fang, Midlothian, VA (US); Randy Rousseau, Richmond, VA (US)

(73) Assignee: AFTON CHEMICAL CORPORATION, Richmond, VA (US)

( * ) Notice: Subject to any disclaimer, the term of this patent is extended or adjusted under 35 U.S.C. 154(b) by 0 days.

(21) Appl. No.: 16/662,843

(22) Filed: Oct. 24, 2019

(65) Prior Publication Data

US 2021/0122994 A1 Apr. 29, 2021

(51) Int. Cl.

| | |
|---|---|
| ***C10M 169/04*** | (2006.01) |
| ***C10M 141/10*** | (2006.01) |
| ***C10N 30/00*** | (2006.01) |
| ***C10N 30/04*** | (2006.01) |
| ***C10N 40/04*** | (2006.01) |

(52) U.S. Cl.

CPC ..... *C10M 169/044* (2013.01); *C10M 141/10* (2013.01); *C10M 2203/003* (2013.01); *C10M 2207/141* (2013.01); *C10M 2207/144* (2013.01); *C10M 2207/26* (2013.01); *C10M 2207/262* (2013.01); *C10M 2215/28* (2013.01); *C10M 2217/028* (2013.01); *C10M 2219/044* (2013.01); *C10M 2219/046* (2013.01); *C10M 2223/04* (2013.01); *C10N 2030/04* (2013.01); *C10N 2030/45* (2020.05); *C10N 2030/52* (2020.05); *C10N 2040/04* (2013.01)

(58) Field of Classification Search

CPC ..... C10M 141/10; C10M 169/044; C10M 2203/003; C10M 2207/141; C10M 2207/144; C10M 2207/26; C10M 2207/262; C10M 2215/28; C10M 2217/028; C10M 2219/044; C10M 2219/046; C10M 2223/04; C10M 2207/028; C10M 2207/044; C10M 2207/046; C10N 2030/04; C10N 2030/45; C10N 2030/52; C10N 2040/04

See application file for complete search history.

(56) References Cited

U.S. PATENT DOCUMENTS

| | | | |
|---|---|---|---|
| 2,063,629 | A | 12/1936 | Salzberg et al. |
| 2,224,695 | A | 12/1940 | Prutton |
| 2,447,288 | A | 8/1948 | Smith et al. |
| 2,616,905 | A | 11/1952 | Asseff et al. |
| 3,178,663 | A | 4/1965 | Kahn |
| 3,185,647 | A | 5/1965 | Anderson et al. |
| 3,189,544 | A | 6/1965 | Hyman et al. |
| 3,256,185 | A | 6/1966 | Le Suer |
| 3,278,550 | A | 10/1966 | Norman et al. |
| 3,312,619 | A | 4/1967 | Vineyard |
| 3,366,569 | A | 1/1968 | Norman et al. |
| 3,390,086 | A | 6/1968 | O'Halloran |
| 3,403,102 | A | 9/1968 | Le Seur |
| 3,458,530 | A | 7/1969 | Siegel et al. |
| 3,470,098 | A | 9/1969 | O'Halloran |
| 3,502,677 | A | 3/1970 | Le Suer |
| 3,519,564 | A | 7/1970 | Vogel |

(Continued)

FOREIGN PATENT DOCUMENTS

| | | | |
|---|---|---|---|
| GB | 1065595 | A | 4/1967 |
| GB | 2140811 | B | 5/1985 |

(Continued)

OTHER PUBLICATIONS

McFadden, Chris, et al. "Electrical conductivity of new and used automatic transmission fluids." SAE International Journal of Fuels and Lubricants 9.3 (2016): 519-526.

Extended European Search Report for corresponding European application No. 20201650.7; dated Mar. 11, 2021 (7 pages).

* cited by examiner

*Primary Examiner* — James C Goloboy

(74) *Attorney, Agent, or Firm* — Mendelsohn Dunleavy, P.C.

(57) ABSTRACT

A method of lubricating at least a portion of a powertrain in a vehicle with an electric motor with a functional fluid composition containing greater than 50 wt % of a base oil; and an additive composition prepared by mixing:

a) a hydrocarbyl acid phosphate of the formula (I) to provide at least 50 ppmw phosphorus to the functional fluid composition;

(I)

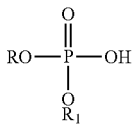

wherein R is a $C_1$-$C_6$ hydrocarbyl group and $R_1$ is selected from hydrogen and a $C_1$-$C_6$ hydrocarbyl group;

b) an amount of one or more calcium-containing detergent (s) sufficient to provide at least 25 ppmw calcium to the functional fluid composition; and c) one or more nitrogen containing dispersants in an amount sufficient to provide greater than 20 ppmw of nitrogen to the functional fluid composition, all based on the total weight of the functional fluid composition. Functional fluid compositions containing the above-mentioned components and lubricating methods are also disclosed herein.

22 Claims, No Drawings

(56) References Cited

U.S. PATENT DOCUMENTS

| | | | |
|---|---|---|---|
| 3,546,243 | A | 12/1970 | Coupland |
| 3,573,205 | A | 3/1971 | Lowe et al. |
| 3,634,515 | A | 1/1972 | Piasek et al. |
| 3,649,229 | A | 3/1972 | Otto |
| 3,708,522 | A | 1/1973 | Le Suer |
| 3,749,695 | A | 7/1973 | de Vries |
| 3,859,318 | A | 1/1975 | Lesuer |
| 3,865,740 | A | 2/1975 | Goldschmidt |
| 3,865,813 | A | 2/1975 | Gergel |
| 3,954,639 | A | 5/1976 | Liston |
| 3,984,448 | A | 10/1976 | Lippsmeier |
| 4,152,499 | A | 5/1979 | Boerzel et al. |
| 4,234,435 | A | 11/1980 | Meinhardt et al. |
| 4,379,064 | A | 4/1983 | Cengel et al. |
| 4,431,552 | A | 2/1984 | Salentine |
| 4,482,464 | A | 11/1984 | Karol et al. |
| 4,521,318 | A | 6/1985 | Karol |
| 4,554,086 | A | 11/1985 | Karol et al. |
| 4,579,675 | A | 4/1986 | Sawicki et al. |
| 4,612,132 | A | 9/1986 | Wollenberg et al. |
| 4,614,522 | A | 9/1986 | Buckley |
| 4,614,603 | A | 9/1986 | Wollenberg |
| 4,617,137 | A | 10/1986 | Plavac |
| 4,617,138 | A | 10/1986 | Wollenberg |
| 4,636,322 | A | 1/1987 | Nalesnik |
| 4,645,515 | A | 2/1987 | Wollenberg |
| 4,647,390 | A | 3/1987 | Buckley, III et al. |
| 4,648,886 | A | 3/1987 | Buckley, III et al. |
| 4,648,980 | A | 3/1987 | Erdman |
| 4,652,387 | A | 3/1987 | Andress, Jr. et al. |
| 4,663,062 | A | 5/1987 | Wollenberg |
| 4,663,064 | A | 5/1987 | Nalesnik et al. |
| 4,666,459 | A | 5/1987 | Wollenberg |
| 4,666,460 | A | 5/1987 | Wollenberg |
| 4,668,246 | A | 5/1987 | Wollenberg |
| 4,670,170 | A | 6/1987 | Wollenberg |
| 4,699,724 | A | 10/1987 | Nalesnik et al. |
| 4,713,189 | A | 12/1987 | Nalesnik et al. |
| 4,713,191 | A | 12/1987 | Nalesnik |
| 4,857,214 | A | 8/1989 | Papay et al. |
| 4,948,386 | A | 8/1990 | Sung et al. |
| 4,963,275 | A | 10/1990 | Gutierrez et al. |
| 4,963,278 | A | 10/1990 | Blain et al. |
| 4,971,598 | A | 11/1990 | Andress et al. |
| 4,971,711 | A | 11/1990 | Lundberg et al. |
| 4,973,412 | A | 11/1990 | Migdal et al. |
| 4,981,492 | A | 1/1991 | Blain et al. |
| 5,026,495 | A | 6/1991 | Emert et al. |
| 5,030,249 | A | 7/1991 | Herbstman et al. |
| 5,039,307 | A | 8/1991 | Herbstman et al. |
| 5,075,383 | A | 12/1991 | Migdal et al. |
| 5,241,003 | A | 8/1993 | Degonia et al. |
| 5,334,321 | A | 8/1994 | Harrison et al. |
| 5,354,484 | A | 10/1994 | Schwind et al. |
| 5,739,355 | A | 4/1998 | Gateau et al. |
| 5,763,372 | A | 6/1998 | Tersigni et al. |
| 6,107,257 | A | 8/2000 | Valcho et al. |
| 6,548,458 | B2 | 4/2003 | Loper |
| 7,214,649 | B2 | 5/2007 | Loper et al. |
| 7,253,231 | B2 | 8/2007 | Devlin et al. |
| 7,307,048 | B2 * | 12/2007 | Sagawa ..... C10M 167/00 508/371 |
| 7,485,603 | B2 | 2/2009 | Bera et al. |
| 7,645,726 | B2 | 1/2010 | Loper |
| 7,732,390 | B2 | 6/2010 | Kadkhodayan et al. |
| 7,786,057 | B2 | 8/2010 | Bera et al. |
| 7,897,696 | B2 | 3/2011 | Huang et al. |
| 8,048,831 | B2 | 11/2011 | Loper |
| 8,400,030 | B1 * | 3/2013 | Tang ..... B60L 50/15 310/54 |
| 2010/0075875 | A1 * | 3/2010 | Yaguchi ..... C10M 169/04 508/192 |
| 2012/0040874 | A1 * | 2/2012 | Toda ..... C10M 169/044 508/364 |
| 2014/0018271 | A1 | 1/2014 | Onumata et al. |
| 2018/0100114 | A1 * | 4/2018 | Gao ..... C10M 169/04 |
| 2019/0010417 | A1 * | 1/2019 | Yanagihara ..... C10M 141/10 |
| 2020/0157457 | A1 * | 5/2020 | Iwasaki ..... C10M 141/10 |

FOREIGN PATENT DOCUMENTS

| | | | | |
|---|---|---|---|---|
| JP | 2007217596 | A | 8/2007 | |
| JP | 6073748B2 | B2 | 2/2017 | |
| JP | 2019147919 | A | 9/2019 | |
| WO | 8707638 | A2 | 12/1987 | |
| WO | WO-2017159363 | A1 * | 9/2017 | ..... C10M 137/02 |

SYNERGISTIC LUBRICANTS WITH REDUCED ELECTRICAL CONDUCTIVITY

TECHNICAL FIELD

The present disclosure relates to functional fluids with reduced electrical conductivity, and methods for reducing electrical conductivity in an electric or hybrid vehicle powertrain fluid. More specifically, the disclosure relates to electric or hybrid vehicle powertrain fluid compositions comprising an additive composition prepared by mixing a hydrocarbyl acid phosphate, one or more calcium-containing detergents, and dispersants, wherein the functional fluid has reduced electrical conductivity, and methods for reducing electrical conductivity in an electric or hybrid vehicle powertrain fluid by lubricating the portions of a powertrain in in the electric or hybrid vehicle with the functional fluid having reduced electrical conductivity.

BACKGROUND

Electric vehicles are typically equipped with electric motors, and hybrid electric vehicles are typically equipped with electric motor(s) in combination with a combustion engine. Functional fluids used to lubricate the powertrain of electric and hybrid vehicles may come into contact with parts of the electric motor. A concern has arisen about the electrical properties of these functional fluids being sufficiently conductive to short circuit the electrical motor. Accordingly, functional fluids for powertrains in electric and hybrid vehicles desirably have a relatively lower electrical conductivity to ensure electric motor reliability.

One additive known to contribute to an increase in electrical conductivity of lubricants is a metal-containing detergent. Such metal-containing detergents are typically required to be present in an amount that provides suitable oxidation control. Accordingly, there is a tension between reducing the amount of metal-containing detergent in order to reduce electrical conductivity and maintaining a sufficient amount of detergent to provide acceptable oxidation control.

With the current trend toward more energy efficient vehicles, it is desirable to provide a multipurpose functional fluid that may be used to lubricate mechanical components, provide lower electrical conductivity, low Noack volatility, antiwear performance, and oxidation control.

US 2014/0018271 relates to functional fluid compositions with insulation and anti-wear properties for lubricating transmissions and other devices. The functional fluid compositions comprise a functional fluid base oil; at least one type of phosphorus compound selected from the group consisting of phosphorus compounds having at least one hydroxyl group and/or at least one thiol group; and an ashless dispersant having a functional group containing a dispersion group in an amount of less than 0.001 percent by mass on the basis of the amount of nitrogen in the total composition mass, or no ashless dispersant at all. These functional fluid compositions have a volume resistivity at 80° C. of $5\times10^8$ Ω·m or greater.

US 2019/0010417 relates to functional fluid compositions having a high intermetallic friction coefficient and having both initial clutch anti-shudder performance and clutch anti-shudder durability, a lubrication method and a transmission including the functional fluid composition. The functional fluid composition contains an amide compound, a metal-based detergent, and at least one phosphorus acid ester selected from an acid phosphate ester and an acid phosphite ester.

JP 60-73748 B2 relates to a functional fluid composition which is said to be excellent in oxidation stability, extreme pressure performance, friction characteristics and electrical insulating properties. The composition comprises 0.2 to 0.5% of an ashless dispersant, based on the total weight of the functional fluid composition, and 0.05 to 0.15% of a phosphate compound having alkyl groups containing 6 to 12 carbon atoms.

"Electrical Conductivity of New and Used Automatic Transmission Fluids," McFadden, Chris, et al., *SAE Int. J. Fuels Lubr.* 9(3):2016 discusses the electrical conductivity of transmission fluids. This article describes the effects of various transmission fluid additives on the electrical conductivity of the fluid and demonstrates that the conductivity of the transmission fluid increases over time, due to oil oxidation and a reduction in the viscosity of the fluid. This article also mentions that the electrical conductivity of the transmission fluid should be low enough so that the functional fluid is a good electrical insulator but also high enough to that the functional fluid can dissipate static charge.

The present disclosure is directed to the provision of functional fluids having electrical conductivities suitable for use in powertrains of electric and hybrid vehicles that also provide acceptable anti-wear properties and oxidation performance, and to methods for lubricating the powertrain of electric and hybrid vehicles with these functional fluid compositions.

SUMMARY AND TERMS

In a first aspect, the disclosure relates to a method of lubricating at least a portion of a powertrain in a vehicle having an electric motor including a step of lubricating the portion of the powertrain with a functional fluid composition. The functional fluid composition includes at least:

greater than 50 wt % of a base oil, based on a total weight of the functional fluid composition; and an additive composition prepared by mixing:

a) a hydrocarbyl acid phosphate of the formula (I) in an amount sufficient to provide at least 50 ppmw phosphorus to the functional fluid composition, based on the total weight of the functional fluid composition:

(I)

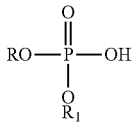

wherein R is a linear or branched hydrocarbyl group having 1 to 6 carbon atoms and $R_1$ is selected from hydrogen and a linear or branched hydrocarbyl group having 1 to 6 carbon atoms;

b) an amount of one or more calcium-containing detergent (s) sufficient to provide at least 25 ppmw calcium to the functional fluid composition, based on the total weight of the functional fluid composition; and c) one or more nitrogen containing dispersants in an amount sufficient to provide greater than 20 ppmw of nitrogen to the functional fluid composition, based on the total weight of the functional fluid composition.

In the foregoing embodiment, greater than 50 wt % of the base oil may be a polyalphaolefin. In some embodiments, the functional fluid composition may comprise greater than 50 wt % of polyalphaolefin and the base oil may additionally comprise an ester. Further, in each of the foregoing embodiments, the functional fluid composition may have a kinematic viscosity of less than 6 cSt at 100° C., as measured by the method of ASTM D2770.

In each of the foregoing embodiments, the one or more calcium-containing detergent(s) may include a low-based calcium-containing detergent or an overbased calcium-containing detergent. The low-based calcium-containing detergent may have a total base number of up to 175 mg KOH/g, or up to 155 mg KOH/g, as measured by the method of ASTM D-2896. The overbased calcium-containing detergent may have a total base number of greater than 225 mg KOH/g, or greater than 250 mg KOH/g, as measured by the method of ASTM D-2896. In each of the foregoing embodiments, the one or more calcium-containing detergent(s) may include a compound selected from an overbased calcium sulfonate detergent, an overbased calcium phenate detergent, and an overbased calcium salicylate detergent.

In each of the foregoing embodiments, the hydrocarbyl acid phosphate may be a mixture of hydrocarbyl acid phosphates. In each of the foregoing embodiments, R may be a hydrocarbyl group having from 1 to 5 carbon atoms and $R_1$ may be a hydrocarbyl group having from 1 to 5 carbon atoms or $R_1$ is hydrogen. In each of the foregoing embodiments, the hydrocarbyl acid phosphate may be selected from the group consisting of amyl acid phosphate, methyl acid phosphate, propyl acid phosphate, diethyl acid phosphate, butyl acid phosphate and mixtures thereof. In the foregoing embodiments, the hydrocarbyl acid phosphate may comprise amyl acid phosphate, methyl acid phosphate or mixtures thereof.

In each of the foregoing embodiments, the one or more calcium-containing detergent(s) may be present in an amount sufficient to provide at least 25 ppmw calcium to up to 800 ppmw calcium, or 50-800 ppmw calcium, or 50-600 ppmw calcium, or 50-400 ppmw calcium, or 50-200 ppmw calcium, or 50-150 ppmw calcium to the functional fluid composition, based on the total weight of the functional fluid composition.

In each of the foregoing embodiments, the hydrocarbyl acid phosphate may be present in an amount sufficient to provide at least 50 ppmw of phosphorus, or at least 100 ppmw of phosphorus, or at least 100 ppmw to 500 ppmw of phosphorus, or 200-500 ppmw of phosphorus, or 250-350 ppmw of phosphorus to the functional fluid composition, based on the total weight of the functional fluid composition.

In each of the foregoing embodiments, the weight ratio of the ppmw of calcium provided by the one or more calcium-containing detergent(s) to the ppmw of phosphorus provided by the hydrocarbyl acid phosphate may be from about 1:1 to 1:10, or from about 1:2 to 1:10, or from about 1:2 to 1:7.5, or from about 1:2 to 1:5.

In each of the foregoing embodiments, the nitrogen containing dispersant may be a polyisobutenyl succinimide. In each of the foregoing embodiments, the nitrogen containing dispersant may be present in an amount sufficient to provide greater than 100 ppmw of nitrogen, or greater than 300 ppmw nitrogen, or greater than 500 ppmw nitrogen, or greater than 600 ppmw nitrogen, or 20-2000 ppmw nitrogen, or 100-1200 ppmw nitrogen or 300 to 800 ppmw nitrogen, or 300 to 500 ppmw nitrogen to the functional fluid composition, based on the total weight of the functional fluid composition.

In each of the foregoing embodiments, the functional fluid composition may further include one or more optional components selected from the group consisting of corrosion inhibitors, antioxidants, and viscosity modifiers.

In each of the foregoing embodiments, the functional fluid composition may be a functional fluid, selected from electric vehicle powertrain fluids and hybrid vehicle powertrain fluids.

In each of the foregoing embodiments, the functional fluid may have an electrical conductivity of from 80,000 pS/m to 180,000 pS/m. In each of the foregoing embodiments, the electrical conductivity of the functional fluid may be determined by the method of ASTM D-2624-15 with a digital conductivity meter from EMCEE Electronics, at 170° C. The digital conductivity meter had a conductivity range from 1-200,000 pS/m.

In each of the foregoing embodiments, the functional fluid composition may not contain an amide.

In a second aspect, the disclosure relates to a method of lubricating at least a portion of a powertrain in a vehicle having an electric motor including a step of lubricating the portion of the powertrain with a functional fluid composition including:

greater than 50 wt % of a base oil, based on a total weight of the functional fluid composition; and an additive composition prepared by mixing:

a) a hydrocarbyl acid phosphate of the formula (I) in an amount sufficient to provide from 200-500 ppmw phosphorus to the functional fluid composition, based on the total weight of the functional fluid composition:

(I)

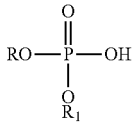

wherein R is a linear or branched hydrocarbyl group having 1 to 6 carbon atoms and $R_1$ is selected from hydrogen and a linear or branched hydrocarbyl group having 1 to 6 carbon atoms;

b) one or more overbased calcium-containing detergent(s) having a total base number of at least 225 mg KOH/mg, as measured by the method of ASTM D2896, in an amount sufficient to provide at least 25 ppmw calcium to the functional fluid composition, based on the total weight of the functional fluid composition; and c) one or more nitrogen containing dispersants in an amount sufficient to provide 300-800 ppmw of nitrogen to the functional fluid composition, based on the total weight of the functional fluid composition.

In the foregoing embodiment, a weight ratio of the ppmw of calcium provided by the one or more overbased calcium-containing detergent(s) to the ppmw of phosphorus provided by the hydrocarbyl acid phosphate may be from 1:2 to 1:7.5 or from about 1:2 to 1:5.

In a third aspect, the disclosure relates to a method of lubricating at least a portion of a powertrain in a vehicle having an electric motor including a step of lubricating the portion of the powertrain with a functional fluid composition comprising:

greater than 50 wt % of a base oil, based on a total weight of the functional fluid composition; and an additive composition prepared by mixing:

a) at least one hydrocarbyl acid phosphate selected from amyl acid phosphate, methyl acid phosphate, and mixtures thereof, in an amount sufficient to provide from 200-500 ppmw phosphorus to the functional fluid composition, based on the total weight of the functional fluid composition;

b) one or more overbased calcium-containing detergent(s) having a total base number of at least 225 mg KOH/mg, as measured by the method of ASTM D2896, in an amount sufficient to provide at least 25 ppmw calcium to the functional fluid composition, based on the total weight of the functional fluid composition; and c) one or more nitrogen containing dispersants in an amount sufficient to provide 300-500 ppmw of nitrogen to the functional fluid composition, based on the total weight of the functional fluid composition.

In the foregoing embodiment, a weight ratio of the ppmw of calcium provided by the one or more overbased calcium-containing detergent(s) to the ppmw of phosphorus provided by the at least one hydrocarbyl acid phosphate selected from amyl acid phosphate, methyl acid phosphate, and mixtures thereof may be from 1:2 to 1:7.5 or from about 1:2 to 1:5.

In each of the foregoing embodiments, the functional fluid may have an electrical conductivity of from 80,000 pS/m to 180,000 pS/m, as measured by the method of ASTM D-2624-15 at 170° C. with a digital conductivity meter having a conductivity range from 1-200,000 pS/m.

In a fourth aspect, the disclosure relates to a method of lubricating at least a portion of a powertrain in a vehicle having an electric motor including a step of lubricating the portion of the powertrain with a functional fluid composition comprising:

greater than 50 wt % of a base oil, based on a total weight of the functional fluid composition; and an additive composition prepared by mixing:

a) methyl acid phosphate in an amount sufficient to provide from 200-500 ppmw phosphorus to the functional fluid composition, based on the total weight of the functional fluid composition;

b) one or more overbased calcium-containing detergent(s) having a total base number of at least 225 mg KOH/mg, as measured by the method of ASTM D2896, in an amount sufficient to provide at least 25 ppmw calcium to the functional fluid composition, based on the total weight of the functional fluid composition; and c) one or more nitrogen containing dispersants in an amount sufficient to provide 300-500 ppmw of nitrogen to the functional fluid composition, based on the total weight of the functional fluid composition.

In the foregoing embodiment, a weight ratio of the ppmw of calcium provided by the one or more overbased calcium-containing detergent(s) to the ppmw of phosphorus provided by the methyl acid phosphate may be from 1:2 to 1:7.5 or from about 1:2 to 1:5. Moreover, in the above embodiment, the functional fluid may have an electrical conductivity of from 80,000 pS/m to 180,000 pS/m, as measured by the method of ASTM D-2624-15 at 170° C. with a digital conductivity meter having a conductivity range from 1-200,000 pS/m.

In a fifth aspect, the disclosure relates to a method of lubricating at least a portion of a powertrain in a vehicle having an electric motor including a step of lubricating the portion of the powertrain with a functional fluid composition comprising:

greater than 50 wt % of a base oil, based on a total weight of the functional fluid composition, wherein the base oil comprises greater than 50 wt % of polyalphaolefin; and an additive composition prepared by mixing:

a) methyl acid phosphate in an amount sufficient to provide from 200-350 ppmw phosphorus to the functional fluid composition, based on the total weight of the functional fluid composition;

b) one or more overbased calcium-containing detergent(s) having a total base number of at least 250 mg KOH/mg, as measured by the method of ASTM D2896, in an amount sufficient to provide at least 50 ppmw calcium to the functional fluid composition, based on the total weight of the functional fluid composition; and c) one or more nitrogen containing dispersants in an amount sufficient to provide 300-500 ppmw of nitrogen to the functional fluid composition, based on the total weight of the functional fluid composition;

wherein a weight ratio of the ppmw of calcium provided by the one or more overbased calcium-containing detergent (s) to the ppmw of phosphorus provided by the methyl acid phosphate may be from 1:2 to 1:5; and the functional fluid composition has a kinematic viscosity of less than 6 cSt, at 100° C., as measured by the method of ASTM D2770.

In the foregoing embodiment, the functional fluid may have an electrical conductivity of from 80,000 pS/m to 180,000 pS/m, as determined by the method of ASTM D-2624-15 with a digital conductivity meter from EMCEE Electronics, at 170° C. having a conductivity range from 1-200,000 pS/m.

In each of the foregoing method embodiments, the step of mixing may include mixing the components of the additive composition prior to incorporating the additive composition into the base oil, or the step of mixing may including mixing one or more components of the additive composition in the base oil.

In a sixth aspect, the invention relates to a functional fluid composition that includes:

greater than 50 wt % of a base oil, based on a total weight of the functional fluid composition;

an additive composition prepared by mixing:

a) a hydrocarbyl acid phosphate of the formula (I) in an amount sufficient to provide at least 50 ppmw phosphorus to the functional fluid composition, based on the total weight of the functional fluid composition:

(I)

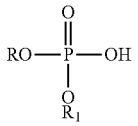

wherein R is a linear or branched hydrocarbyl group having 1 to 6 carbon atoms and $R_1$ is selected from hydrogen and a linear or branched hydrocarbyl group having 1 to 6 carbon atoms;

b) an amount of one or more calcium-containing detergent (s) sufficient to provide at least 25 ppmw calcium to the functional fluid composition, based on the total weight of the functional fluid composition; and c) one or more nitrogen containing dispersants in an amount sufficient to provide greater than 20 ppmw of nitrogen to the functional fluid composition, based on the total weight of the functional fluid composition.

In the foregoing embodiment, the functional fluid composition may not contain an amide.

In each of the foregoing functional fluid composition embodiments, the one or more calcium-containing detergent (s) may include a low-based or an overbased calcium-containing detergent. The low-based calcium-containing detergent may have a total base number of up to 175 mg KOH/g, or up to 155 mg KOH/g, as measured by the method of ASTM D-2896. The overbased calcium-containing detergent may have a total base number of greater than 225 mg KOH/g, or greater than 250 mg KOH/g, as measured by the method of ASTM D-2896. In each of the foregoing embodiments, the overbased calcium-containing detergent may include a compound selected from an overbased calcium sulfonate detergent, an overbased calcium phenate detergent, and an overbased calcium salicylate detergent.

In each of the foregoing functional fluid composition embodiments, the hydrocarbyl acid phosphate may be a mixture of hydrocarbyl acid phosphates. In each of the foregoing embodiments, R may be a hydrocarbyl group having from 1 to 5 carbon atoms and $R_1$ may be a hydrocarbyl group having from 1 to 5 carbon atoms or $R_1$ is hydrogen. In each of the foregoing embodiments, the hydrocarbyl acid phosphate may be selected from the group consisting of amyl acid phosphate, methyl acid phosphate, propyl acid phosphate, diethyl acid phosphate, butyl acid phosphate and mixtures thereof. In each of the foregoing functional fluid composition embodiments, the hydrocarbyl acid phosphate may comprise amyl acid phosphate, methyl acid phosphate or mixtures thereof.

In each of the foregoing functional fluid composition embodiments, the one or more calcium-containing detergent (s) may be present in an amount sufficient to provide at least 25 ppmw calcium to up to 800 ppmw calcium, or 50-800 ppmw calcium, or 50-600 ppmw calcium, or 50-400 ppmw calcium, or 50-200 ppmw calcium to the functional fluid composition, based on the total weight of the functional fluid composition.

In each of the foregoing functional fluid composition embodiments, the hydrocarbyl acid phosphate may be present in an amount sufficient to provide at least 50 ppmw of phosphorus, or at least 100 ppmw of phosphorus, or at least 100 ppmw to 500 ppmw of phosphorus, or 200-500 ppmw of phosphorus, or 250-350 ppmw of phosphorus to the functional fluid composition, based on the total weight of the functional fluid composition.

In each of the foregoing functional fluid composition embodiments, the weight ratio of the ppmw of calcium provided by the one or more calcium-containing detergent(s) to the ppmw of phosphorus provided by the hydrocarbyl acid phosphate may be from about 1:1 to 1:10, or from about 1:2 to 1:10, or from about 1:2 to 1:7.5, or from about 1:2 to 1:5.

In each of the foregoing functional fluid composition embodiments, the nitrogen containing dispersant may be a polyisobutenyl succinimide. In each of the foregoing functional fluid composition embodiments, the nitrogen containing dispersant may be present in an amount sufficient to provide greater than 100 ppmw of nitrogen, or greater than 300 ppmw nitrogen, or greater than 500 ppmw nitrogen, or greater than 600 ppmw nitrogen, or 20-2000 ppmw nitrogen, or 100-1200 ppmw nitrogen or 300 to 800 ppmw nitrogen, or 300 to 500 ppmw nitrogen to the functional fluid composition, based on the total weight of the functional fluid composition.

In each of the foregoing functional fluid composition embodiments, the base oil may comprise greater than 50 wt % of a polyalphaolefin. In some embodiments, the functional fluid composition may comprise greater than 50 wt % of a polyalphaolefin and the base oil may further comprise an ester. Further, each of the foregoing functional fluid composition embodiments may have a kinematic viscosity of less than 6 cSt at 100° C., as measured by the method of ASTM D2770.

In each of the foregoing functional fluid composition embodiments, the functional fluid composition may further include one or more optional components selected from the group consisting of corrosion inhibitors, antioxidants, and viscosity modifiers.

In each of the foregoing functional fluid composition embodiments, the functional fluid composition may be a functional fluid, selected from electric vehicle powertrain fluids and hybrid vehicle powertrain fluids.

In each of the foregoing functional fluid composition embodiments, the functional fluid may have an electrical conductivity of from 80,000 pS/m to 180,000 pS/m. In each of the foregoing embodiments, the electrical conductivity of the functional fluid may be determined by the method of ASTM D-2624-15 with a digital conductivity meter from EMCEE Electronics, at 170° C. The digital conductivity meter had a conductivity range from 1-200,000 pS/m.

In a seventh aspect, the disclosure relates to a functional fluid composition including:

greater than 50 wt % of a base oil, based on a total weight of the functional fluid composition; and an additive composition prepared by mixing:

a) a hydrocarbyl acid phosphate of the formula (I) in an amount sufficient to provide from 200-500 ppmw phosphorus to the functional fluid composition, based on the total weight of the functional fluid composition:

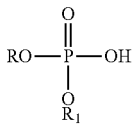

(I)

wherein R is a linear or branched hydrocarbyl group having 1 to 6 carbon atoms and $R_1$ is selected from hydrogen and a linear or branched hydrocarbyl group having 1 to 6 carbon atoms;

b) one or more overbased calcium-containing detergent(s) having a total base number of at least 225 mg KOH/mg, as measured by the method of ASTM D2896, in an amount sufficient to provide at least 25 ppmw calcium to the functional fluid composition, based on the total weight of the functional fluid composition; and c) one or more nitrogen containing dispersants in an amount sufficient to provide 300-800 ppmw of nitrogen to the functional fluid composition, based on the total weight of the functional fluid composition.

In the foregoing embodiment, a weight ratio of the ppmw of calcium provided by the one or more overbased calcium-containing detergent(s) to the ppmw of phosphorus provided by the hydrocarbyl acid phosphate may be from 1:2 to 1:7.5 or from about 1:2 to 1:5.

In an eighth aspect, the disclosure relates to a functional fluid composition including:

greater than 50 wt % of a base oil, based on a total weight of the functional fluid composition; and an additive composition prepared by mixing:

a) at least one hydrocarbyl acid phosphate selected from the group consisting of amyl acid phosphate, methyl acid phosphate and mixtures thereof, in an amount sufficient to provide from 200-500 ppmw phosphorus to the functional fluid composition, based on the total weight of the functional fluid composition;

b) one or more overbased calcium-containing detergent(s) having a total base number of at least 225 mg KOH/mg, as measured by the method of ASTM D2896, in an amount sufficient to provide at least 25 ppmw calcium to the functional fluid composition, based on the total weight of the functional fluid composition; and c) one or more nitrogen containing dispersants in an amount sufficient to provide 300-500 ppmw of nitrogen to the functional fluid composition, based on the total weight of the functional fluid composition.

In the foregoing embodiment, a weight ratio of the ppmw of calcium provided by the one or more overbased calcium-containing detergent(s) to the ppmw of phosphorus provided by the at least one hydrocarbyl acid phosphate selected from the group consisting of amyl acid phosphate, methyl acid phosphate and mixtures thereof, may be from 1:2 to 1:7.5 or from about 1:2 to 1:5. In each of the foregoing embodiments of the eighth aspect, the functional fluid may have an electrical conductivity of from 80,000 pS/m to 180,000 pS/m, as measured by the method of ASTM D-2624-15 at 170° C. with a digital conductivity meter having a conductivity range from 1-200,000 pS/m.

In a ninth aspect, the disclosure relates to a functional fluid composition including: greater than 50 wt % of a base oil, based on a total weight of the functional fluid composition; and an additive composition prepared by mixing:

a) methyl acid phosphate in an amount sufficient to provide from 200-500 ppmw phosphorus to the functional fluid composition, based on the total weight of the functional fluid composition;

b) one or more overbased calcium-containing detergent(s) having a total base number of at least 225 mg KOH/mg, as measured by the method of ASTM D2896, in an amount sufficient to provide at least 25 ppmw calcium to the functional fluid composition, based on the total weight of the functional fluid composition; and c) one or more nitrogen containing dispersants in an amount sufficient to provide 300-500 ppmw of nitrogen to the functional fluid composition, based on the total weight of the functional fluid composition.

In the foregoing embodiment, a weight ratio of the ppmw of calcium provided by the one or more overbased calcium-containing detergent(s) to the ppmw of phosphorus provided by the methyl acid phosphate may be from 1:2 to 1:7.5 or from about 1:2 to 1:5. Moreover, in each of the embodiments of the ninth aspect, the functional fluid may have an electrical conductivity of from 80,000 pS/m to 180,000 pS/m, as measured by the method of ASTM D-2624-15 at 170° C. with a digital conductivity meter having a conductivity range from 1-200,000 pS/m.

In a tenth aspect, the disclosure relates to a functional fluid composition including: greater than 50 wt % of a base oil, based on a total weight of the functional fluid composition, wherein base oil comprises greater than 50 wt % of a polyalphaolefin; and an additive composition prepared by mixing:

a) methyl acid phosphate in an amount sufficient to provide from 200-350 ppmw phosphorus to the functional fluid composition, based on the total weight of the functional fluid composition;

b) one or more overbased calcium-containing detergent(s) having a total base number of at least 250 mg KOH/mg, as measured by the method of ASTM D2896, in an amount sufficient to provide at least 50 ppmw calcium to the functional fluid composition, based on the total weight of the functional fluid composition; and c) one or more nitrogen containing dispersants in an amount sufficient to provide 300-500 ppmw of nitrogen to the functional fluid composition, based on the total weight of the functional fluid composition;

wherein a weight ratio of the ppmw of calcium provided by the one or more overbased calcium-containing detergent(s) to the ppmw of phosphorus provided by the methyl acid phosphate may be from 1:2 to 1:5; and wherein the functional fluid composition has a kinematic viscosity of less than 6 cSt at 100° C., as measured by the method of ASTM D2770.

In the foregoing embodiment, the functional fluid may have an electrical conductivity of from 80,000 pS/m to 180,000 pS/m, as measured by the method of ASTM D-2624-15 at 170° C. with a digital conductivity meter having a conductivity range from 1-200,000 pS/m.

In an eleventh aspect, the disclosure relates to a method of lubricating at least a portion of a powertrain in a vehicle having an electric motor comprising a step of lubricating the portion of the powertrain with a functional fluid composition including:

a) greater than 50 wt % of a base oil, based on a total weight of the functional fluid composition;

b) a reaction product of:

i) a hydrocarbyl acid phosphate of the formula (I) in an amount sufficient to provide at least 50 ppmw phosphorus to the functional fluid composition, based on the total weight of the functional fluid composition:

(I)

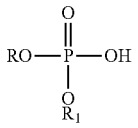

wherein R is a linear or branched hydrocarbyl group having 1 to 6 carbon atoms and $R_1$ is selected from hydrogen and a linear or branched hydrocarbyl group having 1 to 6 carbon atoms; with ii) one or more nitrogen containing dispersants in an amount sufficient to provide greater than 20 ppmw of nitrogen to the functional fluid composition, based on the total weight of the functional fluid composition; and c) an amount of one or more calcium-containing detergent(s) sufficient to provide at least 25 ppmw calcium to the functional fluid composition, based on the total weight of the functional fluid composition.

In a twelfth aspect, the disclosure relates to a functional fluid composition including a) greater than 50 wt % of a base oil, based on a total weight of the functional fluid composition;

b) a reaction product of:

i) a hydrocarbyl acid phosphate of the formula (I) in an amount sufficient to provide at least 50 ppmw phosphorus to the functional fluid composition, based on the total weight of the functional fluid composition:

(I)

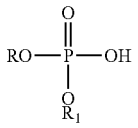

wherein R is a linear or branched hydrocarbyl group having 1 to 6 carbon atoms and $R_1$ is selected from hydrogen and a linear or branched hydrocarbyl group having 1 to 6 carbon atoms; with ii) one or more nitrogen containing dispersants in an amount sufficient to provide greater than 20 ppmw of nitrogen to the functional fluid composition, based on the total weight of the functional fluid composition; and c) an amount of one or more calcium-containing detergent (s) sufficient to provide at least 25 ppmw calcium to the functional fluid composition, based on the total weight of the functional fluid composition; and wherein the functional fluid composition has an electrical conductivity of 80,000 pS/m-200,000 pS/m, as determined by the method of ASTM D2624-15 with a digital conductivity meter from EMCEE Electronics, at 170° C. having a conductivity range of 1-200,000 pS/m.

In each of the first to tenth aspects, the additive composition or the functional fluid composition may comprise a reaction product of components a) and c).

In a thirteenth aspect, the disclosure relates to a method of lubricating at least a portion of a powertrain in a vehicle having an electric motor comprising a step of lubricating the portion of the powertrain with a functional fluid composition including:

greater than 50 wt % of a base oil, based on a total weight of the functional fluid composition;

a hydrocarbyl acid phosphate of the formula (I) in an amount sufficient to provide at least 50 ppmw phosphorus to the functional fluid composition, based on the total weight of the functional fluid composition:

(I)

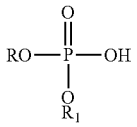

wherein R is a linear or branched hydrocarbyl group having 1 to 6 carbon atoms and $R_1$ is selected from hydrogen and a linear or branched hydrocarbyl group having 1 to 6 carbon atoms;

an amount of one or more calcium-containing detergent(s) sufficient to provide at least 25 ppmw calcium to the functional fluid composition, based on the total weight of the functional fluid composition; and one or more nitrogen containing dispersants in an amount sufficient to provide greater than 20 ppmw of nitrogen to the functional fluid composition, based on the total weight of the functional fluid composition.

In a fourteenth aspect, the disclosure relates to a functional fluid composition including:

greater than 50 wt % of a base oil, based on a total weight of the functional fluid composition;

a hydrocarbyl acid phosphate of the formula (I) in an amount sufficient to provide at least 50 ppmw phosphorus to the functional fluid composition, based on the total weight of the functional fluid composition:

(I)

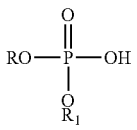

wherein R is a linear or branched hydrocarbyl group having 1 to 6 carbon atoms and $R_1$ is selected from hydrogen and a linear or branched hydrocarbyl group having 1 to 6 carbon atoms;

an amount of one or more calcium-containing detergent(s) sufficient to provide at least 25 ppmw calcium to the functional fluid composition, based on the total weight of the functional fluid composition;

one or more nitrogen containing dispersants in an amount sufficient to provide greater than 20 ppmw of nitrogen to the functional fluid composition, based on the total weight of the functional fluid composition; and wherein the functional fluid composition has an electrical conductivity of 80,000 pS/m-200,000 pS/m, as determined by the method of ASTM D2624-15 with a digital conductivity meter from EMCEE Electronics, at 170° C. having a conductivity range of 1-200,000 pS/m.

Additional features and advantages of the disclosure may be set forth in part in the description which follows, and/or may be learned by practice of the disclosure. The features and advantages of the disclosure may be further realized and attained by means of the elements and combinations particularly pointed out in the appended claims.

It is to be understood that both the foregoing general description and the following detailed description are exemplary and explanatory only and are not restrictive of the disclosure, as claimed.

The following definitions of terms are provided in order to clarify the meanings of certain terms as used herein.

The terms "oil composition," "lubrication composition," "lubricating oil composition," "lubricating oil," "lubricant composition," "lubricating composition," "fully formulated lubricant composition," "lubricant" and "transmission fluid," refer to a finished lubrication product comprising a major amount of a base oil plus a minor amount of an additive composition.

As used herein, the terms "additive package," "additive concentrate," "additive composition," and "transmission fluid additive package" refer the portion of the lubricating oil composition excluding the major amount of base oil.

The term "overbased" relates to metal salts, such as metal salts of sulfonates, carboxylates, salicylates, and/or phenates, wherein the amount of metal present exceeds the stoichiometric amount. Such salts may have a conversion level in excess of 100% (i.e., they may comprise more than 100% of the theoretical amount of metal needed to convert the acid to its "normal," neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, the MR, is greater than one. They are commonly referred to as overbased, hyperbased, or superbased salts and may be salts or organic sulfur acids, carboxylic acids, salicylates, and/or phenols. In the present disclosure, the overbased detergents have a TBN of greater than 225 mg KOH/g. the overbased detergent may also be a combination of two or more overbased detergents each having a TBN of greater than 225 mg KOH/g. In some instances, "overbased" may be abbreviated "OB."

In the present disclosure, a low-based detergent has a TBN of up to 175 mg KOH/g. The low-based detergent may be a combination of two or more low-based and detergents each having a TBN up to 175 mg KOH/g.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties of from about 1 to about 200 carbon atoms.

The term "alkenyl" as employed herein refers to straight, branched, cyclic, and/or substituted unsaturated chain moieties of from about 3 to about 30 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

A "functional fluid" is a term which encompasses a variety of fluids which may be used in the powertrain of an electric or hybrid vehicle.

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

DETAILED DESCRIPTION

The invention relates to methods for lubrication of a powertrain of a vehicle with an electric motor as well as functional fluid compositions useful in such methods. The functional fluid composition includes:

greater than 50 wt % of a base oil, based on a total weight of the functional fluid composition;

an additive composition prepared by mixing a) a hydrocarbyl acid phosphate of the formula (I) in an amount sufficient to provide at least 50 ppmw phosphorus to the functional fluid composition, based on the total weight of the functional fluid composition:

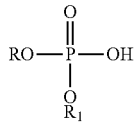

(I)

wherein R is a linear or branched hydrocarbyl group having 1 to 6 carbon atoms and $R_1$ is selected from hydrogen and a linear or branched hydrocarbyl group having 1 to 6 carbon atoms;

b) an amount of one or more calcium-containing detergent(s) sufficient to provide at least 25 ppmw calcium to the functional fluid composition, based on the total weight of the functional fluid composition; and c) one or more nitrogen containing dispersants in an amount sufficient to provide greater than 20 ppmw of nitrogen to the functional fluid composition, based on the total weight of the functional fluid composition.

The functional fluid compositions of this disclosure have reduced electrical conductivity, while still providing acceptable antiwear properties and/or oxidation control. The functional fluid compositions disclosed herein have an electrical conductivity of from 80,000 pS/m to 180,000. As used herein, electrical conductivity is measured according to ASTM D2624-15 at 170° C., using a Digital Conductivity Meter from EMCEE Electronics, with a digital conductivity meter having a conductivity range from 1-200,000 pS/m.

The functional fluid compositions of the present disclosure are functional fluids intended for use in electric vehicles and hybrid vehicles.

The Base Oil

Base oils suitable for use in formulating the functional fluids for use in electric and hybrid vehicles according to the disclosure may be selected from any of suitable synthetic or natural oils or mixtures thereof having a suitable lubricating viscosity. Natural oils may include animal oils and vegetable oils (e.g., castor oil, lard oil) as well as mineral functional fluids such as liquid petroleum oils and solvent treated or acid-treated mineral lubricating oils of the paraffinic, naphthenic or mixed paraffinic-naphthenic types. Oils derived from coal or shale may also be suitable. The base oil may have a kinematic viscosity of 2 to 15 cSt or, as a further example, 2 to 10 cSt at 100° C., as measured by the method of ASTM D2770. Further, oil derived from a gas-to-liquid process is also suitable.

Suitable synthetic base oils may include alkyl esters of dicarboxylic acids, polyglycols and alcohols, poly-alpha-olefins, including polybutenes, alkyl benzenes, organic esters of phosphoric acids, and polysilicone oils. Synthetic oils include hydrocarbon oils such as polymerized and interpolymerized olefins (e.g., polybutylenes, polypropylenes, propylene isobutylene copolymers, etc.); poly(l-hexenes), poly-(1-octenes), poly(l-decenes), etc. and mixtures thereof; alkylbenzenes (e.g., dodecylbenzenes, tetradecylbenzenes, di-nonylbenzenes, di-(2-ethylhexyl)benzenes, etc.); polyphenyls (e.g., biphenyls, terphenyl, alkylated polyphenyls, etc.); alkylated diphenyl ethers and the derivatives, analogs and homologs thereof and the like.

Alkylene oxide polymers and interpolymers and derivatives thereof where the terminal hydroxyl groups have been modified by esterification, etherification, etc., constitute another class of known synthetic oils that may be used. Such oils are exemplified by the oils prepared through polymerization of ethylene oxide or propylene oxide, the alkyl and aryl ethers of these polyoxyalkylene polymers (e.g., methylpolyisopropylene glycol ether having a number average molecular weight of 1000, diphenyl ether of polyethylene glycol having a number average molecular weight of 500-1000, diethyl ether of polypropylene glycol having a molecular weight of 1000-1500, etc.) or mono- and polycarboxylic esters thereof, for example, the acetic acid esters, mixed $C_3$-$C_8$ fatty acid esters, or the $C_{13}$ oxo-acid diester of tetraethylene glycol, where the number average molecular weight is determined by gel permeation chromatography (GPC) using commercially available polystyrene standards (with a number average molecular weight of 180 to about 18,000 as the calibration reference).

Another class of synthetic oils that may be used includes the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di-(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

The base oil used which may be used to make the electric or hybrid fluid compositions as described herein may be a single base oil or may be a mixture of two or more base oils. In particular, the one or more base oil(s) may desirably be selected from any of the base oils in Groups I-V as specified in the American Petroleum Institute (API) Base Oil Interchangeability Guidelines. Such base oil groups are shown in Table 1 as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

In one variation, in each of the foregoing embodiments, the base oil may be selected from a Group II base oil having at least 90% saturates, a Group III base oil having at least 90% saturates, a Group IV base oil, a Group V base oil or a mixture of two or more of these base oils. Alternatively, the base oil may be a Group III base oil, or a Group IV base oil, or a Group V base oil, or the base oil may be a mixture of two or more of a Group III base oil, a Group IV base oil and a Group V base oil.

The base oil may contain a minor or major amount of a poly-alpha-olefin (PAO). Typically, the poly-alpha-olefins are derived from monomers having from 4 to 30, or from 4 to 20, or from 6 to 16 carbon atoms. Examples of useful PAOs include those derived from octene, decene, mixtures thereof, and the like. PAOs may have a kinematic viscosity of from 2 to 15, or from 3 to 12, or from 4 to 8 cSt at 100° C., as measured by the method of ASTM D2770. Examples of PAOs include 4 cSt at 100° C. poly-alpha-olefins, 6 cSt at 100° C. poly-alpha-olefins, and mixtures thereof. Mixtures of mineral oil with the foregoing poly-alpha-olefins may be used.

The base oil may be an oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized using processes disclosed in U.S. Pat. No. 6,103,099 or 6,180,575; hydrocracked and hydroisomerized using processes disclosed in U.S. Pat. No. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

Unrefined, refined, and rerefined oils, either natural or synthetic (as well as mixtures of two or more of any of these) of the type disclosed hereinabove can be used in the base oils. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives, contaminants, and oil breakdown products.

The base oil may be combined with an additive composition as disclosed in embodiments herein to provide electric or hybrid vehicle powertrain fluid compositions. Accordingly, the base oil may be present in the functional fluid composition described herein in an amount greater than about 50 wt % based on a total weight of the functional fluid composition.

In some embodiments, the base oil comprises greater than 50 wt % of a polyalphaolefin. In some embodiments, the functional fluid composition may comprise greater than 50 wt % of polyalphaolefin and the base oil may further comprise an ester. Further, the functional fluid composition may have a kinematic viscosity of less than 6 cSt at 100° C., as measured by the method of ASTM D2770.

Additive Composition

The functional fluid composition includes an additive composition obtained from a hydrocarbyl acid phosphate, one or more calcium-containing detergents, and one or more nitrogen containing dispersants. The additive composition may prepared in several ways.

In one embodiment, the additive composition is prepared by mixing the hydrocarbyl acid phosphate, the one or more calcium containing detergents, and the one or more nitrogen containing dispersants prior to incorporating the additive composition into the base oil.

In another embodiment, the additive composition is prepared by mixing the one or more hydrocarbyl acid phosphate, the one or more calcium containing detergents, and/or the one or more nitrogen containing dispersants of the additive composition in the base oil.

In another embodiment, some of the components of the additive composition may be pre-mixed prior to incorporating the additive composition in the base oil and other components of the additive composition may be added directly to the base oil.

In another embodiment, the additive composition includes a reaction product of the hydrocarbyl acid phosphate and the one or more nitrogen containing dispersants. These components may, for example, react to form amine salts of the hydrocarbyl acid phosphate. Examples of such salts include oil-soluble amine salts of a phosphoric acid ester, such as those taught in U.S. Pat. Nos. 5,354,484 and 5,763,372, the disclosures of which are hereby incorporated by reference.

The amine salts of the present disclosure can be prepared by reaction of a hydrocarbyl acid phosphate represented by the Formula (I) with a nitrogen containing dispersant. For example, the oil-soluble amine salts can be prepared by mixing the hydrocarbyl acid phosphate with the nitrogen containing dispersant at room temperature. Generally, mixing at room temperature for a period of up to about one hour is sufficient. The amount of amine reacted with the hydrocarbyl acid phosphate to from the salts of the disclosure may be at least one equivalent of the amine (based on nitrogen) per equivalent of acid phosphate, and the ratio of these equivalents is generally about one.

Methods for the preparation of such amine salts are well known and reported in the literature. See for example, U.S. Pat. Nos. 2,063,629; 2,224,695; 2,447,288; 2,616,905; 3,984,448; 4,431,552; 5,354,484; Pesin et al, Zhurnal Obshchei Khimii, Vol, 31 No. 8, pp. 2508-2515 (1961); and PCT International Application Publication No. WO 87/07638, the disclosures of all of which are hereby incorporated by reference.

Alternatively, the salts can be formed in situ when the hydrocarbyl acid phosphate is blended with the nitrogen containing dispersant when forming an additive concentrate or in the fully formulated functional fluid composition.

In another embodiment, the additive composition includes a hydrocarbyl acid phosphate, one or more calcium-containing detergent(s), and one or more nitrogen containing dispersants.

The Hydrocarbyl Acid Phosphate

The hydrocarbyl acid phosphates of the present disclosure are employed in an amount sufficient to provide at least 50 ppm phosphorus to the functional fluid composition, based on the total weight of the functional fluid composition. The hydrocarbyl acid phosphates may be represented by the formula (I):

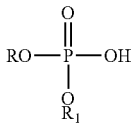

(I)

wherein R is a linear or branched hydrocarbyl group having 1 to 6 carbon atoms and $R_1$ is selected from hydrogen and a linear or branched hydrocarbyl group having 1 to 6 carbon atoms.

In one aspect, R is a linear or branched hydrocarbyl group having from 1 to 5 carbon atoms, and $R_1$ is selected from hydrogen and a linear or branched hydrocarbyl group having from 1 to 5 carbon atoms.

In another aspect, R may be a linear or branched alkyl group having from 1 to 5 carbon atoms, and $R_1$ may be selected from hydrogen and a linear or branched alkyl group having from 1 to 5 carbon atoms.

Compounds of the formula (I) can be obtained using known methods. The phosphorus compounds can be mixtures of phosphorus compounds and are generally mixtures of mono- and dihydrocarbyl-substituted phosphoric acids.

Preferred hydrocarbyl acid phosphates include $C_1$-$C_5$ acid phosphates such as mono-amyl acid phosphate, bis-amyl acid phosphate, di-amyl acid phosphate, methyl acid phosphate, propyl acid phosphate, diethyl acid phosphate, butyl acid phosphate, and mixtures thereof. In some embodiments, the hydrocarbyl acid phosphate is selected from amyl acid phosphate, methyl acid phosphate, and mixtures thereof.

The hydrocarbyl acid phosphate is employed in an amount sufficient to provide from about 200-500 ppmw phosphorus to the functional fluid composition, based on the total weight of the functional fluid composition.

The hydrocarbyl acid phosphate is present in an amount sufficient to provide at least 50 ppmw of phosphorus, or at least 100 ppmw of phosphorus, or at least 100 ppmw to 500 ppmw of phosphorus, or 200-500 ppmw of phosphorus, or 250-350 ppmw of phosphorus to the functional fluid composition, based on the total weight of the functional fluid composition.

In some embodiments, the hydrocarbyl acid phosphate is methyl acid phosphate and is employed in an amount sufficient to provide from about 200-500 ppmw, or from 200-350 ppmw phosphorus to the functional fluid composition, based on the total weight of the functional fluid composition.

The hydrocarbyl acid phosphates of the present disclosure may be additionally reacted with other components often used in functional fluids described herein. For example, it is understood by those of ordinary skill in the art that hydrocarbyl acid phosphates often react with free amines and with the amine portion of dispersants. Accordingly, the hydrocarbyl acid phosphates of the present disclosure may provide a mixture of phosphorus compounds reacted with other compounds in the functional fluid compositions. When used herein, the hydrocarbyl acid phosphate represented by formula (I) above, includes hydrocarbyl acid phosphates reacted with other componentry, such as amines, and the resonance isomers thereof. It is possible for one skilled in the art to elucidate the mixture of phosphorus compounds, including the relative amounts, by using certain spectroscopic techniques. One convenient spectroscopic tool for determining the amount and type of phosphorus compounds within a lubricant composition is phosphorus-31 nuclear magnetic resonance spectroscopy (P31 NMR). P31 NMR spectra can provide quantitative details about the individual phosphorus compounds present using an NMR technique known as signal integration. Accordingly, the P31 NMR signature, including the relative intensity of the signal, as measured by integration, provides a unique spectral fingerprint that allows one skilled in the art to identify the hydrocarbyl acid phosphate within the functional fluid.

Nitrogen-Containing Dispersants

The one or more nitrogen containing dispersants may be employed in an amount sufficient to provide greater than 20 ppmw of nitrogen to the functional fluid composition, based on the total weight of the functional fluid composition.

Suitable nitrogen-containing dispersants of the present application may be a reaction product of a hydrocarbyl-dicarboxylic acid or anhydride and a polyamine. The hydrocarbyl moiety of the hydrocarbyl-dicarboxylic acid or anhydride of may be derived from butene polymers, for example polymers of isobutylene. Suitable polyisobutenes for use herein include those formed from polyisobutylene or highly reactive polyisobutylene having at least 60%, such as 70% to 90% and above, terminal vinylidene content. Suitable polyisobutenes may include those prepared using $BF_3$ catalysts. The number average molecular weight (Mn) of the polyalkenyl substituent may vary over a wide range, for example from 100 to 5000, such as from 500 to 5000, as determined by gel permeation chromatography (GPC) using commercially available polystyrene standards (with a number average molecular weight of 180 to about 18,000 as the calibration reference). The dicarboxylic acid or anhydride may be selected from carboxylic reactants other than maleic anhydride, such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and $C_1$-$C_4$ aliphatic esters. A mole ratio of maleic anhydride to hydrocarbyl moiety in a reaction mixture used to make the hydrocarbyl-dicarboxylic acid or anhydride may vary widely. Accordingly, the mole ratio may vary from 5:1 to 1:5, for example from 3:1 to 1:3. A particularly suitable molar ratio of anhydride to hydrocarbyl moiety is from 1:1 to less than 1.6:1.

Any numerous polyamines may be used in preparing the nitrogen-containing dispersant. Non-limiting exemplary polyamines may include aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine may comprise a mixture of polyalkylenepolyamines having small amounts of polyamine oligomers such as TEPA and PEHA, but primarily oligomers having seven or more nitrogen atoms, two or more primary amines per molecule, and more extensive branching than conventional polyamine mixtures. Additional non-limiting polyamines which may be used to prepare the hydrocarbyl-substituted succinimide dispersant are disclosed in U.S. Pat. No. 6,548,458, the disclosure of which is incorporated herein by reference in its entirety. In an embodiment of the disclosure, the polyamine may be selected from tetraethylene pentamine (TEPA).

In an embodiment, the functional fluid compositions may include a nitrogen-containing dispersant according to the Formula (III):

(III)

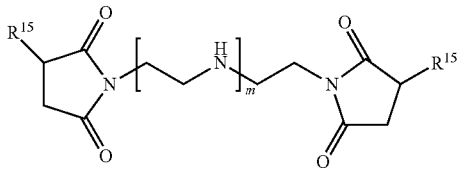

wherein m represents 0 or an integer of from 1 to 5, and $R^{15}$ is a hydrocarbyl substituent as defined above. In an embodiment, m is 3 and $R^{15}$ is a polyisobutenyl substituent, such as that derived from polyisobutylenes having at least 60%, such as 70% to 90% and above, terminal vinylidene content. Compounds of Formula (III) may be the reaction product of a hydrocarbyl-substituted succinic anhydride, such as a polyisobutenyl succinic anhydride (PIBSA), and a polyamine, for example tetraethylene pentamine (TEPA). Compounds of Formula (III) may also be the reaction product of a hydrocarbyl-substituted succinic anhydride, such as a polyisobutenyl succinic anhydride (PIBSA), and polyamines such as heavy polyamines.

The foregoing compound of Formula (III) may have a molar ratio of (A) polyisobutenyl-substituted succinic anhydride to (B) polyamine in the range of 4:3 to 1:10 in the compound. A particularly useful dispersant contains polyisobutenyl group of the polyisobutenyl-substituted succinic anhydride having a Mn in the range of from 500 to 5000, as determined by the GPC method described above and a (B) polyamine having a general formula $H_2N(CH_2)_x$—[NH $(CH_2)_x]_y$—$NH_2$, wherein x is in the range from 2 to 4 and y is in the range of from 1 to 2.

Ashless-type nitrogen-containing dispersants are preferred for use in the functional fluid compositions of the present invention. Ashless-type dispersants, prior to mixing in the functional fluid composition, do not contain ash-forming metals and do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with Mn of the polyisobutylene substituent in the range about 350 to about 5,000, or to about 3,000, as determined by gel permeation chromatography (GPC) method described above. Succinimide dispersants and their preparation are disclosed, for instance in U.S. Pat. No. 7,897,696 or 4,234,435. The polyolefin may be prepared from polymerizable monomers containing about 2 to about 16, or about 2 to about 8, or about 2 to about 6 carbon atoms.

In an embodiment, the functional fluids include at least one polyisobutylene succinimide dispersant derived from polyisobutylene with number average molecular weight in the range about 350 to about 5000, or to about 3000, as determined by GPC as described above. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000, as determined by GPC as described above, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000, as determined by GPC as described above, may be suitable. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment, the functional fluid comprises at least one nitrogen-containing dispersant derived from polyisobutylene succinic anhydride ("PIBSA"). The PIBSA may have an average of between about 1.0 and about 2.0 succinic acid moieties per polymer. The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

In one embodiment, the nitrogen-containing dispersant may be derived from a polyalphaolefin (PAO) succinic anhydride.

In one embodiment, the nitrogen-containing dispersant may be derived from olefin maleic anhydride copolymer. As an example, the nitrogen-containing dispersant may be described as a poly-PIBSA.

In an embodiment, the nitrogen-containing dispersant may be derived from an anhydride which is reacted or grafted to an ethylene-propylene copolymer.

A suitable class of nitrogen-containing dispersants may be derived from olefin copolymers (OCP), more specifically, ethylene-propylene dispersants which may be grafted with maleic anhydride. A more complete list of nitrogen-containing compounds that can be reacted with the functionalized OCP are described in U.S. Pat. Nos. 7,485,603; 7,786,057; 7,253,231; 6,107,257; and 5,075,383; and/or are commercially available.

One class of suitable nitrogen-containing dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of nitrogen-containing dispersants may be high molecular weight esters.

A suitable nitrogen-containing dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with:

Inorganic phosphorus acids or anhydrates (e.g., U.S. Pat. Nos. 3,403,102 and 4,648,980);

Organic phosphorus compounds (e.g., U.S. Pat. No. 3,502,677);

Phosphorus pentasulfides;

Boron compounds as already noted above (e.g., U.S. Pat. Nos. 3,178,663 and 4,652,387);

Carboxylic acid, polycarboxylic acids, anhydrides and/or acid halides (e.g., U.S. Pat. Nos. 3,708,522 and 4,948,386);

Epoxides, polyepoxides or thioexpoxides (e.g., U.S. Pat. Nos. 3,859,318 and 5,026,495);

Aldehyde or ketone (e.g., U.S. Pat. No. 3,458,530);

Carbon disulfide (e.g., U.S. Pat. No. 3,256,185);

Glycidol (e.g., U.S. Pat. No. 4,617,137);

Urea, thiourea or guanidine (e.g., U.S. Pat. Nos. 3,312,619; 3,865,813; and British Patent GB 1,065,595);

Organic sulfonic acid (e.g., U.S. Pat. No. 3,189,544 and British Patent GB 2,140,811);

Alkenyl cyanide (e.g., U.S. Pat. Nos. 3,278,550 and 3,366,569);

Diketene (e.g., U.S. Pat. No. 3,546,243);

A diisocyanate (e.g., U.S. Pat. No. 3,573,205);

Alkane sulfone (e.g., U.S. Pat. No. 3,749,695);

1,3-Dicarbonyl Compound (e.g., U.S. Pat. No. 4,579,675);

Sulfate of alkoxylated alcohol or phenol (e.g., U.S. Pat. No. 3,954,639);

Cyclic lactone (e.g., U.S. Pat. Nos. 4,617,138; 4,645,515; 4,668,246; 4,963,275; and 4,971,711);

Cyclic carbonate or thiocarbonate, linear monocarbonate or polycarbonate, or chloroformate (e.g., U.S. Pat. Nos. 4,612,132; 4,647,390; 4,648,886; 4,670,170);

Nitrogen-containing carboxylic acid (e.g., U.S. Pat. No. 4,971,598 and British Patent GB 2,140,811);

Hydroxy-protected chlorodicarbonyloxy compound (e.g., U.S. Pat. No. 4,614,522);

Lactam, thiolactam, thiolactone or ditholactone (e.g., U.S. Pat. Nos. 4,614,603 and 4,666,460);

Cyclic carbamate, cyclic thiocarbamate or cyclic dithiocarbamate (e.g., U.S. Pat. Nos. 4,663,062 and 4,666,459);

Hydroxyaliphatic carboxylic acid (e.g., U.S. Pat. Nos. 4,482,464; 4,521,318; 4,713,189);

Oxidizing agent (e.g., U.S. Pat. No. 4,379,064);

Combination of phosphorus pentasulfide and a polyalkylene polyamine (e.g., U.S. Pat. No. 3,185,647);

Combination of carboxylic acid or an aldehyde or ketone and sulfur or sulfur chloride (e.g., U.S. Pat. Nos. 3,390,086; 3,470,098);

Combination of a hydrazine and carbon disulfide (e.g. U.S. Pat. No. 3,519,564);

Combination of an aldehyde and a phenol (e.g., U.S. Pat. Nos. 3,649,229; 5,030,249; 5,039,307);

Combination of an aldehyde and an O-diester of dithiophosphoric acid (e.g., U.S. Pat. No. 3,865,740);

Combination of a hydroxyaliphatic carboxylic acid and a boric acid (e.g., U.S. Pat. No. 4,554,086);

Combination of a hydroxyaliphatic carboxylic acid, then formaldehyde and a phenol (e.g., U.S. Pat. No. 4,636,322);

Combination of a hydroxyaliphatic carboxylic acid and then an aliphatic dicarboxylic acid (e.g., U.S. Pat. No. 4,663,064);

Combination of formaldehyde and a phenol and then glycolic acid (e.g., U.S. Pat. No. 4,699,724);

Combination of a hydroxyaliphatic carboxylic acid or oxalic acid and then a diisocyanate (e.g. U.S. Pat. No. 4,713,191);

Combination of inorganic acid or anhydride of phosphorus or a partial or total sulfur analog thereof and a boron compound (e.g., U.S. Pat. No. 4,857,214);

Combination of an organic diacid then an unsaturated fatty acid and then a nitrosoaromatic amine optionally followed by a boron compound and then a glycolating agent (e.g., U.S. Pat. No. 4,973,412);

Combination of an aldehyde and a triazole (e.g., U.S. Pat. No. 4,963,278); Combination of an aldehyde and a triazole then a boron compound (e.g., U.S. Pat. No. 4,981,492); and Combination of cyclic lactone and a boron compound (e.g., U.S. Pat. Nos. 4,963,275 and 4,971,711). The above mentioned patents are herein incorporated in their entireties.

The TBN of a suitable dispersant may be from about 10 to about 65 mg KOH/g on an oil-free basis, which is comparable to a TBN of about 5 to about 30 mg KOH/g if measured on a dispersant sample containing about 50% diluent oil. The TBN of the dispersants described herein are measured by ASTM D2896.

The nitrogen-containing dispersant can be used in an amount sufficient to provide from 0.001 wt % to about 10 wt %, based upon the final weight of the functional fluid composition. Another amount of the dispersant that can be used may be about 0.01 wt % to about 8.0 wt %, or from about 0.1 wt % to about 5.0 wt %, or from about 1.0 wt % to about 5.0 wt %, based upon the final weight of the functional fluid composition. In some embodiments, the functional fluid composition utilizes a mixed dispersant system. A single type or a mixture of two or more types of dispersants in any desired ratio may be used.

The nitrogen-containing dispersant is present in an amount sufficient to provide greater than 20 ppmw of nitrogen, or greater than 100 ppmw of nitrogen, or greater than 300 ppmw nitrogen, or greater than 500 ppmw nitrogen, or greater than 600 ppmw, or 20-2000 ppmw nitrogen, or 100-1200 ppmw nitrogen or 300 to 800 ppmw nitrogen, or from about 300 to 500 pmmw to the functional fluid composition, based on the total weight of the functional fluid composition, based on the total weight of the functional fluid composition.

Calcium-Containing Detergents

The functional fluid composition may include one or more calcium-containing detergent(s) sufficient to provide at least 25 ppmw of calcium to the functional fluid composition, based on the total weight of the functional fluid composition.

In some embodiments, the one or more calcium-containing detergents may comprise one or more overbased calcium-containing detergents or one or more low-based calcium-containing detergents, or mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein. A suitable detergent may include alkali or alkaline earth metal salts of petroleum sulfonic acids and long chain mono- or di-alkylarylsulfonic acids with the aryl group being benzyl, tolyl, and xylyl.

Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, or calcium methylene bridged phenols.

Overbased and low-based detergents are well known in the art and may be alkali or alkaline earth metal overbased detergents. Such detergents may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" or "low-based" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is 1 and in an overbased salt or low-based salt, MR, is greater than 1. They are commonly referred to as overbased, hyperbased, or superbased salts and may be salts of organic sulfur acids, carboxylic acids, or phenols.

An overbased detergent may have a TBN of greater than about 225 mg KOH/gram or greater, or a TBN of about 250 mg KOH/gram or greater, or a TBN of about 300 mg KOH/gram or greater, or a TBN of about 350 mg KOH/gram or greater, or a TBN of about 375 mg KOH/gram or greater, or a TBN of about 400 mg KOH/gram or greater, as measured by the method of ASTM D-2896. The calcium-containing detergent of the present invention may include an overbased calcium-containing detergent.

Examples of suitable overbased calcium-containing detergents include, but are not limited to, overbased calcium phenates, overbased calcium sulfur-containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, or overbased calcium methylene bridged phenols. Preferably, the one or more calcium-containing detergents comprises an overbased calcium containing detergent selected from an overbased calcium sulfonate detergent, an overbased calcium phenate detergent, and an overbased calcium salicylate.

The overbased detergent may have a metal to substrate ratio of from 1.1:1, or from 2:1, or from 4:1, or from 5:1, or from 7:1, or from 10:1.

A low-based detergent may have a TBN of up to 175 mg KOH/g, or up to 150 mg KOH/g, as measured by the method of ASTM D-2896. The calcium-containing detergent of the present invention may include a low-based calcium-containing detergent.

Examples of suitable low-based calcium-containing detergents include, but are not limited to low-based calcium sulfonates, low-based calcium sulfur-containing phenates, and low-based calcium salicylates. In some embodiments, the low-based calcium-containing detergent is a calcium sulfonate detergent, calcium salicylate detergent, or a calcium phenate detergent.

Preferably, the one or more calcium-containing detergent(s) of the present invention comprises a calcium-containing detergent selected from calcium sulfonate detergents, calcium phenate detergents, calcium salicylate detergents or mixtures thereof. Alternatively, the one or more calcium-containing detergent(s) of the present invention comprises overbased calcium phenate detergent Alternatively, the calcium-containing detergents of the present invention comprise overbased calcium sulfonate detergents. Alternatively, the calcium-containing detergents of the present invention comprise overbased calcium salicylate detergents.

In each of the foregoing embodiments, the calcium-containing detergent may be present in an amount to provide at least 25 ppmw calcium to up to 800 ppmw calcium, or 50-300 ppmw calcium, or 50-200 ppmw calcium, or 50-150 ppmw calcium to the functional fluid composition, based on the total weight of the functional fluid composition.

In some embodiments, the calcium-containing detergent is present in an amount such that the weight ratio of the ppmw of calcium provided by the one or more calcium-containing detergent(s) to the ppmw of phosphorus provided by the hydrocarbyl acid phosphate is from 1:1 to 1:10, or from about 1:1 to 1:10, or from 1:2 to 1:7.5, or from 1:2 to 1:5.

Other Optional Components

The functional fluid composition described herein may also include conventional additives of the type used in transmission fluid compositions in addition to the components described above. Such additives include, but are not limited to, additional detergent additives, additional dispersants, antioxidants, viscosity modifiers, friction modifiers, sulfur-containing components, additional phosphorus-containing components, corrosion inhibitors, antirust additives, metal deactivators, antifoamants, pour point depressants, air entrainment additives, seal swell agents, and the like.

Additional Dispersants

An additional dispersant additive that may be used may be a reaction product of a hydrocarbyl-dicarboxylic acid or anhydride and a polyamine. The hydrocarbyl moiety of the hydrocarbyl-dicarboxylic acid or anhydride of may be derived from butene polymers, for example polymers of isobutylene. Suitable polyisobutenes for use herein include those formed from polyisobutylene or highly reactive polyisobutylene having at least 60%, such as 70% to 90% and above, terminal vinylidene content. Suitable polyisobutenes may include those prepared using BF3 catalysts. The number average molecular weight of the polyalkenyl substituent may vary over a wide range, for example from 100 to 5000, such as from 500 to 5000, as determined by gel permeation chromatography (GPC) as described above.

The dicarboxylic acid or anhydride of may be selected from carboxylic reactants other than maleic anhydride, such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and C1-C4 aliphatic esters. A mole ratio of maleic anhydride to hydrocarbyl moiety in a reaction mixture used to make the hydrocarbyl-dicarboxylic acid or anhydride may vary widely. Accordingly, the mole ratio may vary from 5:1 to 1:5, for example from 3:1 to 1:3. A particularly suitable molar ratio of anhydride to hydrocarbyl moiety is from 1:1 to less than 1.6:1.

Any of numerous polyamines can be used as in preparing the dispersant additive. Non-limiting exemplary polyamines may include aminoguanidine bicarbonate (AGBC), diethylene triamine (DETA), triethylene tetramine (TETA), tetraethylene pentamine (TEPA), pentaethylene hexamine (PEHA) and heavy polyamines A heavy polyamine may comprise a mixture of polyalkylenepolyamines having small amounts of polyamine oligomers such as TEPA and PEHA, but primarily oligomers having seven or more nitrogen atoms, two or more primary amines per molecule, and more extensive branching than conventional polyamine mixtures. Additional non-limiting polyamines which may be used to prepare the hydrocarbyl-substituted succinimide dispersant are disclosed in U.S. Pat. No. 6,548,458, the disclosure of which is incorporated herein by reference in its entirety. In an embodiment of the disclosure, the polyamine may be selected from tetraethylene pentamine (TEPA).

In some embodiments, the dispersant may be an ashless dispersant. In some embodiments, the lubricating composition may further comprise a minor amount of an ashless dispersant that is boronated and/or phosphorylated. Accordingly, in one embodiment, the dispersant additive has a nitrogen content of up to 10,000 ppmw by weight, for example from 0.5 to 0.8 wt % and a boron plus phosphorus to nitrogen ((B+P)/N) weight ratio of from 0:1 to 0.8:1. The amount of total nitrogen contributed by the dispersant in the lubricating composition may be greater than 50 by weight for example, and more preferably, greater than 600 ppmw by weight based on a total weight of the lubricating composition.

Corrosion Inhibitors

Rust or corrosion inhibitors may also be included in the functional fluid compositions described herein. Such materials include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like.

Another useful type of rust inhibitor may be alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols.

Other suitable rust or corrosion inhibitors include ether amines; acid phosphates; amines; polyethoxylated compounds such as ethoxylated amines, ethoxylated phenols, and ethoxylated alcohols; imidazolines; aminosuccinic acids or derivatives thereof, and the like.

Thiazoles, triazoles and thiadiazoles may also be used as corrosion inhibitors in the functional fluids described herein. Examples include benzotriazole; tolyltriazole; octyltriazole; decyltriazole; dodecyltriazole; 2-mercaptobenzothiazole; 2,5-dimercapto-1,3,4-thiadiazole; 2-mercapto-5-hydrocarbylthio-1,3,4-thiadiazoles; and 2-mercapto-5-hydrocarbyldithio-1,3,4-thiadiazoles. In one embodiment, the thiadiazoles are 1,3,4-thiadiazoles. In another embodiment, the thiadiazoles are 2-hydrocarbyldithio-5-mercapto-1,3,4-dithiadiazoles.

Mixtures of such rust or corrosion inhibitors may be used. The total amount of corrosion inhibitor, when present in the lubricating composition described herein may range up to 5.0 wt % or from 0.01 to 2.0 wt % based on the total weight of the functional fluid composition.

Antioxidants

In some embodiments, antioxidant compounds may be included in the functional fluid compositions described herein. Antioxidants include phenolic antioxidants, aromatic amine antioxidants, sulfurized phenolic antioxidants, and organic phosphites, among others. Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-ter-t-butylphenol), and mixed methylene-bridged polyalkyl phenols, and 4,4'-thiobis(2-methyl-6-tert-butylphenol). N,N'-di-sec-butyl-phenylenediamine, 4-isopropylaminodiphenylamine, phenyl-.alpha.-naphthyl amine, phenyl-.alpha.-naphthyl amine, and ring-alkylated diphenylamines Examples include the sterically hindered tertiary butylated phenols, bisphenols and cinnamic acid derivatives and combinations thereof.

Aromatic amine antioxidants include, but are not limited to diarylamines having the formula:

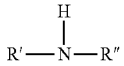

wherein R' and R' each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

Examples of diarylamines that may be used include, but are not limited to: diphenylamine; various alkylated diphenylamines; 3-hydroxydiphenylamine; N-phenyl-1,2-phenylenediamine; N-phenyl-1,4-phenylenediamine; monobutyldiphenyl-amine; dibutyldiphenylamine; monooctyldiphenylamine; dioctyldiphenylamine; mononononyldiphenylamine; dinonyldiphenylamine; monotetradecyldiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyl-diphenylamine; p-oriented styrenated diphenylamine; mixed butyloctyldi-phenylamine; and mixed octylstyryldiphenylamine.

The sulfur containing antioxidants include, but are not limited to, sulfurized olefins that are characterized by the type of olefin used in their production and the final sulfur content of the antioxidant. High molecular weight olefins, i.e. those olefins having a number average molecular weight of 168 to 351 g/mole, as determined by gel permeation chromatography (GPC) as described above, are preferred. Examples of olefins that may be used include alpha-olefins, isomerized alpha-olefins, branched olefins, cyclic olefins, and combinations of these.

Alpha-olefins include, but are not limited to, any C4 to C25 alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and combinations of these.

The amount of sulfurized olefin or sulfurized fatty oil delivered to the finished lubricating composition is based on the sulfur content of the sulfurized olefin or fatty oil and the desired level of sulfur to be delivered to the finished lubricating composition. For example, a sulfurized fatty oil or olefin containing 20 weight % sulfur, when added to the finished lubricating composition at a 1.0 weight % treat level, will deliver 2000 ppmw of sulfur to the finished lubricating composition. A sulfurized fatty oil or olefin containing 10 weight % sulfur, when added to the finished lubricating composition at a 1.0 weight % treat level, will deliver 1000 ppmw sulfur to the finished lubricating composition. It is desirable that the sulfurized olefin or sulfurized fatty oil to deliver between 200 ppmw and 2000 ppmw sulfur to the finished lubricating composition.

The total amount of antioxidant in the functional fluid compositions described herein may range from 0.01 to 3.0 wt % based on the total weight of the functional fluid composition. As a further example, antioxidant may be present in a preferred amount of from 0.1 wt % to 1.0 wt %, based on the total weight of the functional fluid composition.

Extreme Pressure Agents

The functional fluid composition may optionally contain one or more extreme pressure agents. Extreme pressure (EP) agents that are soluble in the oil include sulfur- and chlorosulfur-containing EP agents, chlorinated hydrocarbon EP agents and phosphorus EP agents. Examples of such EP agents include chlorinated waxes; organic sulfides and polysulfides such as sulfurized polyisobutylene, sulfurized fatty acids, dibenzyldisulfide, bis(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof. Preferred extreme pressure agents are sulfurized polyisobutylene and sulfurized fatty acids.

The extreme pressure agent, when present in the functional fluid composition may be present in amount from 0.001 to 3 wt %, preferably from 0.1 to 02.0 wt %, more preferably from 0.02 to 0.15 wt %, most preferably from 0.03 to 0.1 wt % of extreme pressure agents based on the total weight of the functional fluid composition.

Friction Modifiers

The functional fluid compositions herein may also optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanidine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and such hydrocarbyl groups may be saturated or unsaturated. The hydrocarbyl groups may be composed of carbon and hydrogen or hetero atoms such as sulfur or oxygen. The hydrocarbyl groups may range from 12 to 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685.

Aminic friction modifiers may include amines or polyamines Such compounds can have hydrocarbyl groups that are linear, either saturated or unsaturated, or a mixture thereof and may contain from 12 to 25 carbon atoms. Further examples of suitable friction modifiers include alkoxylated amines and alkoxylated ether amines Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291.

A friction modifier may optionally be present in ranges such as 0 wt. % to 6 wt. %, or 0.01 wt. % to 4 wt. %, or 0.05 wt. % to 2 wt. %, based on the total weight of the functional fluid composition.

Seal Swell Agents

The functional fluid composition described herein may optionally contain seal swell agents such as esters, adipates, sebacates, azealates, phtahlates, sulfones, alcohols, alkylbenzenes, substituted sulfolanes, aromatics, or mineral oils that cause swelling of elastomeric materials. Alcohol-type seal swell agents are low volatility linear alkyl alcohols. Examples of suitable alcohols include decyl alcohol, tridecyl alcohol and tetradecyl alcohol. Examples of alkylbenzenes useful as seal swell agents for use in conjunction with the compositions described herein include dodecylbenzenes, tetradecylbenzenes, dinonyl-benzenes, di(2-ethylhexyl)benzene, and the like. Examples of substituted sulfolanes are described in U.S. Pat. No. 4,029,588, incorporated herein by reference. Mineral oils useful as seal swell agents are typically low viscosity mineral oils with high naphthenic or aromatic content. When used in the lubricating composition described herein, a seal swell agent will comprise from 1 to 30 wt %, preferably from 2 to 20 wt %, most preferably from 5 to 15 wt %, based on the total weight of the functional fluid composition.

Anti-Foam Agents

In some embodiments, a foam inhibitor may form another component suitable for use in the functional fluid compositions described herein. Foam inhibitors may be selected from silicones, polyacrylates, and the like. When present, the amount of antifoam agent in the functional fluid compositions described herein may range up to 1.0 wt %, or from 0.001 wt % to 0.1 wt % based on the total weight of the functional fluid composition. As a further example, antifoam agent may be present in a preferred amount of from 0.004 wt % to 0.10 wt %, based on the total weight of the functional fluid composition.

Viscosity Index Improvers

The functional fluid composition may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 2012/0101017 A1.

The functional fluid composition herein also may optionally contain one or more dispersant viscosity index improvers in addition to a viscosity index improver or in lieu of a viscosity index improver. Suitable dispersant viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver, when present, may be up to 30 wt %, or may be from 0.001 wt % to 25 wt %, or 0.01 wt % to 20 wt %, or 0.1 wt % to 15 wt %, or 0.1 wt % to 8 wt %, or 0.5 wt % to 5 wt % based on the total weight of the functional fluid composition.

Pour Point Depressants

The functional fluid composition may optionally contain one ore more pour point depressants. Suitable pour point depressants may include esters of maleic anhydride-styrene, polymethacrylates, polymethylmethacrylates, polyacrylates or polyacrylamides or mixtures thereof. Pour point depressants, when present, may be present in amount from 0.001 wt % to 1 wt %, or 0.01 wt % to 0.5 wt %, or 0.02 wt % to 0.04 wt %, based upon the total weight of the functional fluid composition.

In one embodiment the functional fluid composition may comprise one or more demulsifying agents, such as trialkyl phosphates, polyethylene glycols, polyethylene oxides, polypropylene oxides and (ethylene oxide-propylene oxide) polymers.

In general terms, a suitable lubricating composition may include additive components in the ranges listed in the following Table 2:

TABLE 2

| Component | Wt % (Suitable Embodiments) | Wt % (Preferred Embodiments) |
|---|---|---|
| Hydrocarbyl Acid Phosphate | 0.01-10.0 | 0.1-5.0 |
| Calcium-Containing Detergent | 0.01-5.0 | 0.05-2.0 |
| Nitrogen-Containing Dispersant(s) | 0.001-10.0 | 0.5-5.0 |
| Antioxidant(s) | 0-5.0 | 0.01-3.0 |

TABLE 2-continued

| Component | Wt % (Suitable Embodiments) | Wt % (Preferred Embodiments) |
|---|---|---|
| Additional Phosphorus-Containing Compound(s) | 0-5.0 | 0-3.0 |
| Additional Dispersant(s) | 0-5.0 | 0-2.0 |
| Additional Detergent(s) | 0-10.0 | 0.1-2.0 |
| Corrosion inhibitor(s) | 0-5.0 | 0.1-2.0 |
| Extreme Pressure/Additional Antiwear Agent(s) | 0.0001-10 | 0.01-2.0 |
| Antifoaming agent(s) | 0-1.0 | 0.001-0.1 |
| Friction Modifier(s) | 0-6.0 | 0.05-4.0 |
| Viscosity index improver(s) | 0-30.0 | 0.1-8 |
| Pour point depressant(s) | 0.001-1.0 | 0.01-0.5 |
| Seal swell agent(s) | 0-10.0 | 0.5-5.0 |
| Base oil(s) | Balance | Balance |
| Total | 100 | 100 |

The percentages of each component above represent the weight percent of each component, based upon the total weight of the final functional fluid composition containing the recited component. The remainder of the functional fluid composition consists of one or more base oils.

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

Particularly advantageous applications of the invention would be in electrical and hybrid vehicle powertrains. Electrical and hybrid vehicles have a need for functional fluids having relatively low conductivity to reduce the risk of damage to electrical components in the electric motors of such vehicles.

Also disclosed herein are methods for lubricating a vehicle with an electric motor including a step of lubricating portions of an electric powertrain in the vehicle with a functional fluid composition as described above.

The following examples are illustrative, but not limiting, of the methods and compositions of the present disclosure. Other suitable modifications and adaptations of the variety of conditions and parameters normally encountered in the field, and which are obvious to those skilled in the art, are within the spirit and scope of the disclosure. All patents and publications cited herein are fully incorporated by reference herein in their entirety.

EXAMPLES

The following non-limiting examples are provided in order to further illustrate the features and advantages of one or more embodiments of the disclosure. To demonstrate how the combination of the hydrocarbyl acid phosphate, a calcium-containing detergent and a nitrogen-containing dispersant affected the electrical conductivity of the fluid, exemplary functional fluids were formulated and tested for electrical conductivity. All the amounts listed are stated as weight percent of the component in the functional fluid composition, unless specified otherwise.

Electrical conductivity of the functional fluid compositions was evaluated using the method of ASTM D2624-15 with a digital conductivity meter, EMCEE, having a range of from about 1 to about 200,000 picosiemens $m^{-1}$ (pS/m). All conductivity values were measured at a temperature of 170° C. All conductivity measurements are in picosiemens $m^{-1}$ (pS/m), also known as CU or Conductivity Units.

Example 1

The impact on electrical conductivity based on the incorporation of different hydrocarbyl acid phosphates in combination with various calcium-containing detergents in the functional fluid composition was tested. All the Examples in Table 1 included 2 wt % of an ashless polyisobutylene dispersant (produced from 950 MW polyisobutylene) and containing 2.1 wt % N, as measured by ASTM D5291. This dispersant is treated at an amount to deliver 420 ppmw nitrogen to the functional fluid composition. In addition, all Examples in Table 1 included 2 wt % of diisodecyl adipate, and a PAO mixture of SpectraSyn® 4 and SpectraSyn® 6 to achieve a kinematic viscosity at 100° C. of approximately 5 cSt.

Comparative Example 1 (CE 1) contained amyl acid phosphate treated in an amount to provide 300 ppmw phosphorus to the functional fluid composition. Comparative Example 2 (CE 2) contained a calcium phenate detergent treated in an amount to provide 95 ppmw calcium to the functional fluid composition. Inventive Example 1 (IE 1) included amyl acid phosphate treated in an amount to provide 300 ppmw phosphorus to the functional fluid composition and a calcium phenate detergent treated in an amount to provide 95 ppmw calcium to the functional fluid composition.

Comparative Example 3 (CE 3) contained methyl acid phosphate treated in an amount to provide 280 ppmw phosphorus to the functional fluid composition. Comparative Example 4 (CE 4) contained a calcium sulfonate detergent treated in an amount to provide 119 ppmw calcium to the functional fluid composition. Inventive Example 2 (IE 2) included methyl acid phosphate treated in an amount to provide 280 ppmw phosphorus to the functional fluid composition and a calcium sulfonate detergent treated in an amount to provide 119 ppmw of calcium to the functional fluid composition.

Comparative Example 5 (CE 5) contained 2-ethylhexyl acid phosphate treated in an amount to provide 299 ppmw phosphorus to the functional fluid composition. Comparative Example 6 (CE 6) contained a calcium salicylate detergent treated in an amount to provide 110 ppmw calcium to the functional fluid composition. Comparative Example 7 (CE 7) included 2-ethylhexyl acid phosphate treated in an amount to provide 299 ppmw phosphorus to the functional fluid composition and a calcium salicylate detergent treated in an amount to provide 110 ppmw calcium to the functional fluid composition.

TABLE 3

| Component | CE 1 | CE 2 | IE 1 | CE 3 | CE 4 | IE 2 | CE 5 | CE 6 | CE 7 |
|---|---|---|---|---|---|---|---|---|---|
| Amyl Acid Phosphate (P~15%) | 0.2 | | 0.2 | | | | | | |
| Methyl Acid Phosphate (P~28%) | | | | 0.1 | | 0.1 | | | |
| 2-ethyl hexyl acid phosphate (P~11.55%) | | | | | | | 0.26 | | 0.26 |
| Calcium Phenate (Ca~9.25%) TBN 250 | | 0.1 | 0.1 | | | | | | |
| Calcium Sulfonate (Ca~11.9%) TBN 307 | | | | | 0.1 | 0.1 | | | |
| Ca Salicylate (Ca~11%) TBN 300 | | | | | | | | 0.1 | 0.1 |
| Electrical Conductivity @ 170° C., pS/m | 199k | 196k | 175k | >200k (out of range at 166° C.) | 112k | 165k | 69k | 85k | >200k (out of range at 114° C.) |

As shown in Table 3, formulations CE 1 and CE 2 demonstrate that independently, the presence of amyl acid phosphate or calcium phenate detergent in a functional fluid contributes to high electrical conductivity of the fluid and thus, is undesirable for electric or hybrid vehicle applications. IE 1 demonstrates that the combination of amyl acid phosphate and calcium phenate detergent surprisingly lowers the electrical conductivity of a functional fluid. Moreover, the data indicates that the combination of amyl acid phosphate and calcium phenate detergent has a synergistic effect on lowering the electrical conductivity of a fluid.

Formulation CE 3 demonstrates that independently, the presence of methyl acid phosphate in a functional fluid contributes to high electrical conductivity of the fluid and thus, undesirable for electric or hybrid vehicle applications. Although formulation CE 4 provides relatively low electrical conductivity, it does not include a phosphorus-containing antiwear agent and thus would not provide the required level of antiwear protection. In contrast, formulation IE 2 demonstrates that a fluid comprising the combination of the methyl acid phosphate and the calcium sulfonate detergent has surprisingly low electrical conductivity. In fact, it has the lowest conductivity of any of the examples in Table 1 containing the tested antiwear agents (acid phosphates) and calcium detergents, two types of components required to achieve optimal powertrain performance.

Formulations CE 5, CE 6, CE 7 show that independently, the presence of 2-ethylhexyl acid phosphate or calcium salicylate detergent in a functional fluid contributes to low electrical conductivity of the fluid. However, the combination of the of 2-ethylhexyl acid phosphate and the calcium salicylate detergent significantly increases the electrical conductivity of the fluid.

Accordingly, the testing herein demonstrates that functional fluids comprising acid phosphates having $C_1$-$C_5$ alkyl groups and calcium phenates or calcium sulfonates exhibit surprisingly low electrical conductivity. In particular, the data indicates that the combination of amyl acid phosphate and calcium phenate detergent provides a synergistic effect on the electrical conductivity of a fluid. Further, functional fluids comprising methyl acid phosphates and calcium sulfonates surprisingly have the lowest electrical conductivity of any fluids tested.

Example 2

The impact on electrical conductivity of the incorporation of methyl acid phosphate in combination with various calcium-phenate detergents in the functional fluid compositions of the present invention was tested. All the Examples in Table 4 included an ashless polyisobutylene dispersant (produced from 950 MW polyisobutylene) containing approximately 2.1 wt % N, as measured by ASTM D5291 (treat rate as indicated in Table 4), 0.4 wt % of an aminic antioxidant, 0.01 wt % of a corrosion inhibitor, 2 wt % of diisodecyl adipate, and a PAO mixture of SpectraSyn® 4 and SpectraSyn® 6 to achieve a kV100 of approximately 5 cSt. Each Example in Table 4 contained varying amounts of methyl acid phosphate and calcium phenate as indicated in the table.

Formulation CE 8 contained methyl acid phosphate treated in an amount to provide 280 ppmw by weight of phosphorus to the functional fluid composition, and nitrogen-containing dispersant treated in an amount to provide 397 ppmw by weight of nitrogen to the functional fluid composition. Inventive Examples 3 and 4 (IE 3 and IE4) included methyl acid phosphate treated in an amount to provide 280 ppmw phosphorus to the functional fluid composition, nitrogen-containing dispersant treated at an amount to provide 376 ppmw nitrogen to the functional fluid composition, and a calcium phenate detergent treated in an amount to provide 95 ppmw calcium to the functional fluid composition.

TABLE 4

| Component | CE 8 | IE 3 |
|---|---|---|
| Methyl Acid Phosphate (P ~28%) | 0.1 | 0.1 |
| Calcium Phenate wt % (Ca ~9.25%, TBN 250 | | 0.1 |
| Dispersant, wt % | 1.89 | 1.79 |
| Electrical Conductivity @ 170° C., pS/m | >200k (out of range at 166° C.) | 135.5k |

As shown in Table 4, formulation CE 8 demonstrates that the presence of methyl acid phosphate in the absence of a calcium detergent contributes to high electrical conductivity of the fluid. Formulations IE 3 and IE 4 demonstrate that the combination of methyl acid phosphate and calcium phenate detergent surprisingly lowers the electrical conductivity of the functional fluid. Moreover, IE 4 demonstrates that the combination of methyl acid phosphate and low TPP calcium phenate detergent has an even lower electrical conductivity than IE 3 which employed methyl acid phosphate and conventional calcium phenate.

Example 3

The impact on electrical conductivity of the incorporation of methyl acid phosphate in combination with calcium-salicylate detergents on the functional fluid compositions of the present invention was tested. All of the Examples in Table 5 included an ashless polyisobutylene dispersant (produced from 1300 MW polyisobutylene) containing approximately 1.8 wt % N, as measured by ASTM D5291 (treat rates as indicated in Table 5), 0.4 wt % of an aminic antioxidant, 0.01 wt % of a corrosion inhibitor, 2 wt % of diisodecyl adipate, and a PAO mixture of SpectraSyn® 4 and SpectraSyn® 6 to achieve a kinematic viscosity at 100° C. of approximately 5 cSt.

Formulation CE 10 contained methyl acid phosphate treated in an amount to provide 280 ppmw by weight phosphorus to the functional fluid composition. IE 5 included methyl acid phosphate treated in an amount to provide 280 ppmw by weight of phosphorus to the functional fluid composition and a calcium salicylate detergent treated in an amount to provide 110 ppmw by weight of calcium to the functional fluid composition.

TABLE 5

| | CE 9 | IE 5 |
|---|---|---|
| Component | | |
| Dispersant, wt % | 1.9 | 1.8 |
| Methyl Acid Phosphate (P~28%) | 0.1 | 0.1 |
| Calcium Salicylate (Ca~11%, TBN 300) | | 0.1 |
| Electrical Conductivity @ 170° C., pS/m | 173k | 81.5k |

Formulation CE 9 demonstrates that independently, the presence of methyl acid phosphate in a functional fluid contributes to high electrical conductivity of the fluid. In contrast, formulation IE 5 demonstrates that a fluid comprising a combination of the methyl acid phosphate and a calcium salicylate detergent has surprisingly low electrical conductivity. In fact, it has the lowest electrical conductivity of any of the examples tested containing the tested antiwear agents (acid phosphates) and calcium detergents, two types of components required to achieve optimal powertrain performance.

Other embodiments of the present disclosure will be apparent to those skilled in the art from consideration of the specification and practice of the invention disclosed herein. As used throughout the specification and claims, "a" and/or "an" may refer to one or more than one. Unless otherwise indicated, all numbers expressing quantities of ingredients, properties such as molecular weight, percent, weight percent, ratio, reaction conditions, and so forth used in the specification and claims are to be understood as being modified in all instances by the term "about". Accordingly, unless indicated to the contrary, the numerical parameters set forth in the specification and claims are approximations that may vary depending upon the desired properties sought to be obtained by the present invention. At the very least, and not as an attempt to limit the application by the doctrine of equivalents to the scope of the claims, each numerical parameter should at least be construed in light of the number of reported significant digits and by applying ordinary rounding techniques. Notwithstanding that the numerical ranges and parameters forth the broad scope of the invention are approximations, the numerical values set forth in the specific examples are reported as precisely as possible. Any numerical values, however, inherently contains certain errors necessarily resulting from the standard deviation found in their respective testing measurements. It is intended that the specification and examples be considered as exemplary only, with a true scope of the invention being indicated by the following claims.

It is to be understood that each component, compound, substituent or parameter disclosed herein is to be interpreted as being disclosed for use alone or in combination with one or more of each and every other component, compound, substituent or parameter disclosed herein.

It is also to be understood that each amount/value or range of amounts/values for each component, compound, substituent or parameter disclosed herein is to be interpreted as also being disclosed in combination with each amount/value or range of amounts/values disclosed for any other component(s), compounds(s), substituent(s) or parameter(s) disclosed herein and that any combination of amounts/values or ranges of amounts/values for two or more component(s), compounds(s), substituent(s) or parameters disclosed herein are thus also disclosed in combination with each other for the purposes of this description.

It is further understood that each range disclosed herein is to be interpreted as a disclosure of each specific value within the disclosed range that has the same number of significant digits. Thus, a range of from 1-4 is to be interpreted as an express disclosure of the values 1, 2, 3 and 4.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. A method of lubricating at least a portion of a powertrain in a vehicle having an electric motor comprising a step of lubricating the portion of the powertrain with a functional fluid composition comprising:

greater than 50 wt% of a base oil, based on a total weight of the functional fluid composition; and an additive composition prepared by mixing a) a hydrocarbyl acid phosphate of the formula (I) in an amount sufficient to provide at least 50 ppmw phosphorus to the functional fluid composition, based on the total weight of the functional fluid composition:

(I)

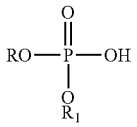

wherein R is a linear or branched hydrocarbyl group having 1 to 6 carbon atoms and $R_1$ is selected from hydrogen and a linear or branched hydrocarbyl group having 1 to 6 carbon atoms;

b) an amount of one or more overbased calcium-containing detergent(s) having a total base number of greater than 225 mg KOH/g, as measured by the method of ASTM D-2896 sufficient to provide at least 25 ppmw calcium to the functional fluid composition, based on the total weight of the functional fluid composition; and c) one or more nitrogen containing dispersants in an amount sufficient to provide greater than 20 ppmw of nitrogen to the functional fluid composition, based on the total weight of the functional fluid composition; and wherein the functional fluid does not contain an amide, and a weight ratio of the ppmw of calcium provided by the one or more overbased calcium-containing detergent(s) to the ppmw of phosphorus provided by the hydrocarbyl acid phosphate is from 1:1 to 1:10, wherein the electrical conductivity of the functional fluid composition as determined by the method of ASTM D2624-15 with a digital conductivity meter at 170° C. having a conductivity range from 1-200,000 pS/m is lower than essentially the same functional fluid in the absence of the one or more overbased calcium-containing detergent(s), and the functional fluid composition has an electrical conductivity of from 80,000 pS/m to 180,000 pS/m as determined by the method of ASTM D2624-15 with a digital conductivity meter at 170° C. having a conductivity range from 1-200,000 pS/m.

2. The method of claim 1, wherein the one or more calcium-containing detergent(s) further comprises a low-based calcium-containing detergent having a total base number of up to 175 mg KOH/g, as measured by the method of ASTM D-2896.

3. The method of claim 2, wherein the one or more overbased calcium-containing detergent(s) comprises a compound selected from an overbased calcium sulfonate detergent, an overbased calcium phenate detergent, and an overbased calcium salicylate detergent.

4. The method of claim 1, wherein the hydrocarbyl acid phosphate is selected from the group consisting of amyl acid phosphate, methyl acid phosphate, propyl acid phosphate, and diethyl acid phosphate, butyl acid phosphate, and mixtures thereof.

5. The method of claim 1, wherein R has from 1 to 5 carbon atoms and $R_1$ has from 1 to 5 carbon atoms or $R_1$ is hydrogen.

6. The method of claim 1, wherein the one or more overbased calcium-containing detergent(s) is present in an amount sufficient to provide at least 25 ppmw calcium to up to 800 ppmw calcium to the functional fluid composition, based on the total weight of the functional fluid composition.

7. The method of claim 1, wherein the hydrocarbyl acid phosphate is present in an amount sufficient to provide at least 200 ppmw of phosphorus to the functional fluid composition, based on the total weight of the functional fluid composition.

8. The method of claim 1, wherein the nitrogen containing dispersant is a polyisobutenyl succinimide.

9. The method of claim 1, wherein the nitrogen containing dispersant is present in an amount sufficient to provide 100-1200 ppmw nitrogen to the functional fluid composition, based on the total weight of the functional fluid composition.

10. The method of claim 1, wherein the functional fluid composition further comprises one or more optional components selected from the group consisting of corrosion inhibitors, antioxidants, and viscosity modifiers.

11. The method of claim 1, wherein said mixing comprises mixing components of the additive composition prior to incorporating the additive composition into the base oil.

12. The method of claim 1, wherein said mixing comprises mixing one or more components of the additive composition in the base oil.

13. A functional fluid composition comprising: and greater than 50 wt% of a base oil, based on a total weight of the functional fluid composition;

an additive composition prepared by mixing:

a) a hydrocarbyl acid phosphate of the formula (I) in an amount sufficient to provide at least 50 ppmw phosphorus to the functional fluid composition, based on the total weight of the functional fluid composition:

(I)

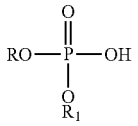

wherein R is a linear or branched hydrocarbyl group having 1 to 6 carbon atoms and $R_1$ is selected from hydrogen and a linear or branched hydrocarbyl group having 1 to 6 carbon atoms;

b) an amount of one or more overbased calcium-containing detergent(s) having a total base number of greater than 225 mg KOH/g, as measured by the method of ASTM D-2896 sufficient to provide at least 25 ppmw calcium to the functional fluid composition, based on the total weight of the functional fluid composition;

c) one or more nitrogen containing dispersants in an amount sufficient to provide greater than 20 ppmw of nitrogen to the functional fluid composition, based on the total weight of the functional fluid composition; and wherein a weight ratio of the ppmw of calcium provided by the one or more overbased calcium-containing detergent(s) to the ppmw of phosphorus provided by the hydrocarbyl acid phosphate is from 1:1 to 1:10; and the functional fluid composition has an electrical conductivity of 80,000 pS/m to 180,000 pS/m, as determined by the method of ASTM D2624-15 with a digital conductivity meter, at 170° C. having a conductivity range of 1-200,000 pS/m, and the electrical conductivity of the functional fluid composition as determined by the method of ASTM D2624-15 with a digital conductivity meter at 170° C. having a conductivity range from 1-200,000 pS/m is lower than essentially the same functional fluid composition in the absence of the one or more overbased calcium-containing detergent(s), and the functional fluid does not contain an amide.

14. The functional fluid composition of claim 13, wherein the one or more calcium-containing detergent(s) further comprises a low-based calcium-containing detergent having a total base number of up to 175 mg KOH/g, as measured by the method of ASTM D-2896.

15. The functional fluid composition of claim 13, wherein the one or more overbased calcium-containing detergent(s) comprise a compound selected from an overbased calcium sulfonate detergent, an overbased calcium phenate detergent, and an overbased calcium salicylate detergent.

16. The functional fluid composition of claim 13, wherein the hydrocarbyl acid phosphate is selected from the group consisting of amyl acid phosphate, methyl acid phosphate, propyl acid phosphate, diethyl acid phosphate, butyl acid phosphate and mixtures thereof.

17. The functional fluid composition of claim 13, wherein R is a hydrocarbyl group having from 1 to 5 carbon atoms and $R_1$ is a hydrocarbyl group having from 1 to 5 carbon atoms or $R_1$ is hydrogen.

18. The functional fluid composition of claim 13, wherein the one or more overbased calcium-containing detergent(s) is present in an amount sufficient to provide at least 25 ppmw calcium to up to 800 ppmw calcium to the functional fluid composition, based on the total weight of the functional fluid composition.

19. The functional fluid composition of claim 13, wherein the hydrocarbyl acid phosphate is present in an amount sufficient to provide at least 50 ppmw to 500 ppmw of phosphorus to the functional fluid composition, based on the total weight of the functional fluid composition.

20. The functional fluid composition of claim 13, wherein the nitrogen containing dispersant is a polyisobutenyl succinimide.

21. The functional fluid composition of claim 13, wherein the nitrogen containing dispersant is present in an amount sufficient to provide 100-1200 ppmw nitrogen to the functional fluid composition, based on the total weight of the functional fluid composition.

22. The functional fluid composition of claim 13, further comprising one or more optional components selected from the group consisting of corrosion inhibitors, antioxidants, and viscosity modifiers.

* * * * *